US007919219B2

(12) United States Patent
Abe et al.

(10) Patent No.: US 7,919,219 B2
(45) **Date of Patent: *Apr. 5, 2011**

(54) ELECTROPHOTOGRAPHIC PHOTOSENSITIVE BODY

(75) Inventors: Katsumi Abe, Fukushima (JP); Atsushi Takesue, Fukushima (JP); Takehiro Nakajima, Fukushima (JP); Makoto Koike, Fukushima (JP); Shinya Nagai, Fukushima (JP)

(73) Assignee: Hodogaya Chemical Co., Ltd., Kawasaki-shi (JP)

( * ) Notice: Subject to any disclaimer, the term of this patent is extended or adjusted under 35 U.S.C. 154(b) by 895 days.

This patent is subject to a terminal disclaimer.

(21) Appl. No.: 11/720,078

(22) PCT Filed: Nov. 21, 2005

(86) PCT No.: PCT/JP2005/021746

§ 371 (c)(1), (2), (4) Date: May 24, 2007

(87) PCT Pub. No.: WO2006/057373

PCT Pub. Date: Jun. 1, 2006

(65) Prior Publication Data

US 2008/0044750 A1 Feb. 21, 2008

(30) Foreign Application Priority Data

Nov. 24, 2004 (JP) ..... 2004-338784

(51) Int. Cl.
*G03G 5/00* (2006.01)

(52) U.S. Cl. ..... 430/58.05; 430/58.35; 430/58.65; 430/58.75

(58) Field of Classification Search ..... 430/58.05, 430/58.35, 58.65, 58.75, 66
See application file for complete search history.

(56) References Cited

U.S. PATENT DOCUMENTS

| | | | | |
|---|---|---|---|---|
| 203,298 | A | 5/1878 | Starr | |
| 4,708,922 | A | 11/1987 | Yokoya et al. | |
| 4,830,944 | A | 5/1989 | Umehara et al. | |
| 4,877,702 | A | 10/1989 | Miyamoto et al. | |
| 2003/0203298 | A1 * | 10/2003 | Abe et al. | 430/72 |
| 2005/0136349 | A1 * | 6/2005 | Mishra et al. | 430/58.05 |

FOREIGN PATENT DOCUMENTS

| | | | |
|---|---|---|---|
| DE | 36 38 417 | A1 | 5/1987 |
| DE | 36 43 341 | A1 | 6/1987 |
| DE | 38 53 401 | | 7/1995 |
| EP | 0 314 195 | A2 | 5/1989 |
| EP | 1752441 | A1 | 2/2007 |
| EP | 1816522 | A1 | 8/2007 |

(Continued)

OTHER PUBLICATIONS

U.S. Appl. No. 11/719,863, filed May 22, 2007, Abe, et al.

(Continued)

*Primary Examiner* — Hoa V Le
(74) *Attorney, Agent, or Firm* — Oblon, Spivak, McClelland, Maier & Neustadt, L.L.P.

(57) ABSTRACT

An object of the present invention is to provide an electrophotographic photosensitive body which is not impaired in electrophotographic characteristics such as charged potential and residual potential, and which is also excellent in repeating stability. The present invention provides an electrophotographic photosensitive body including a conductive support having thereon a layer containing a specific p-terphenyl compound and at least one additive.

19 Claims, 3 Drawing Sheets

FOREIGN PATENT DOCUMENTS

| | | |
|---|---|---|
| FR | 2 592 183 | 6/1987 |
| GB | 2 187 296 | 9/1987 |
| JP | 62-112163 | 5/1987 |
| JP | 62-147462 | 7/1987 |
| JP | 64-44946 | 2/1989 |
| JP | 1-118143 | 5/1989 |
| JP | 1-118845 | 5/1989 |
| JP | 6-73018 | 9/1994 |
| JP | 2001-305764 | 11/2001 |
| JP | 2002-328480 | 11/2002 |
| JP | 2003-202687 | 7/2003 |

OTHER PUBLICATIONS

U.S. Appl. No. 11/597,657, filed Nov. 24, 2006, Abe, et al.
Jikken Kagaku Koza, The Chemical Society of Japan, 4th Edition, vol. 19, pp. 363-482.
Jikken Kagaku Koza, The Chemical Society of Japan, 4th Edition, vol. 20, pp. 279-318.
U.S. Appl. No. 12/840,679, filed Jul. 21, 2010, Abe, et al.

* cited by examiner

ELECTROPHOTOGRAPHIC PHOTOSENSITIVE BODY

TECHNICAL FIELD

The present invention relates to an electrophotographic photosensitive body. More particularly, it relates to an electrophotographic photosensitive body which shows little change in charged potential and residual potential when repeatedly used and excellent durability.

BACKGROUND ART

Conventionally, inorganic photoconductive substances such as selenium, zinc oxide, cadmium sulfide and silicon have widely been used in an electrophotographic photosensitive body. Those inorganic substances had many advantages, and simultaneously had various disadvantages. For example, selenium has the disadvantages that its production conditions are difficult and it is liable to crystallize by heat or mechanical shock. Zinc oxide and cadmium sulfide have problems in moisture resistance and mechanical strength, and have the disadvantage such that electrostatic charge and exposure deterioration take place by a coloring matter added as a sensitizer, thus lacking in durability. Silicon involves that its production conditions are difficult, cost is expensive because of using a gas having strong irritating properties, and care should be taken to handling because of being sensitive to humidity. Additionally, selenium and cadmium sulfide have the problem in toxicity.

Organic photosensitive bodies using various organic compounds that improved disadvantages of those inorganic photosensitive bodies are widely used Organic photosensitive bodies include a single layer photosensitive body having a charge generating agent and a charge transport agent dispersed in a binder resin, and a multi-layered photosensitive body having a charge generating layer and a charge transport layer functionally separated. The characteristics of such a photosensitive body called a functional separation type are that a material suitable to the respective function can be selected from a wide range, and a photosensitive body having an optional function can easily be produced. From such a situation, many investigations have been carried out.

However, although organic materials have many advantages that are not possessed by inorganic materials it is the present situation that organic materials sufficiently satisfying all of characteristics required in electrophotographic photosensitive bodies are not obtained. That is, a decrease in charged potential, an increase in residual potential change in sensitivity and the like due to repeated use give rise to deterioration of image quality. Cause of this deterioration is not completely clarified, but active gases such as ozone and $NO_x$ generated when charging due to corona discharge decomposition of a charge transport agent or the like by ultraviolet light and heat contained in light for exposure and light for removal of electricity, and the like are considered as some factors. For suppression of those deteriorations, a method of combining a hydrazone compound and an antioxidant (for example, see Patent Document 1), a method of combining a butadiene compound and an antioxidant (for example, see Patent Document 2), and the like are known. However, organic materials having good initial sensitivity are not sufficiently improved in deterioration due to repeated use, and organic materials having less deterioration due to repeated use have the problems in initial sensitivity and charging properties Thus it is the present situation that the effect for suppressing deterioration is not yet sufficiently obtained.

Patent Document 1: JP-A-1-44946

Patent Document 2: JP-A-1-18845

DISCLOSURE OF THE INVENTION

In view of the above, an object of the present invention is to provide an electrophotographic photosensitive body having high sensitivity and low residual potential in the initial state, being stable to ozone, light, heat and the like, and showing less fatigue deterioration even in repealed use.

The present invention relates to an electrophotographic photosensitive body which has stable electrophotographic characteristics such as charged potential and residual potential and which is highly durable, comprising a conductive support having thereon a layer comprising at least one p-terphenyl compound selected from the following compounds (1) to (15)

(1)

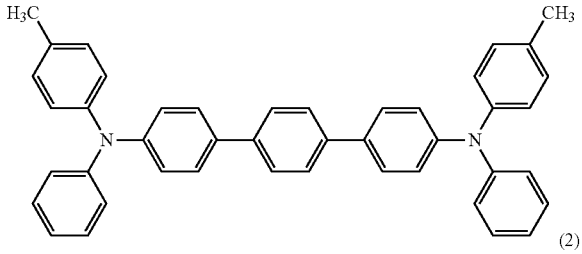

(2)

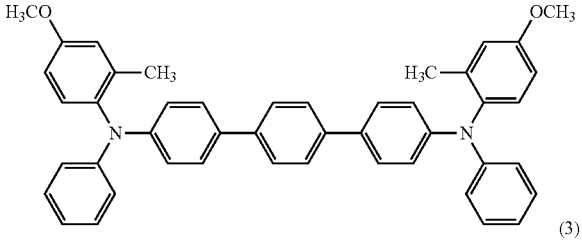

(3)

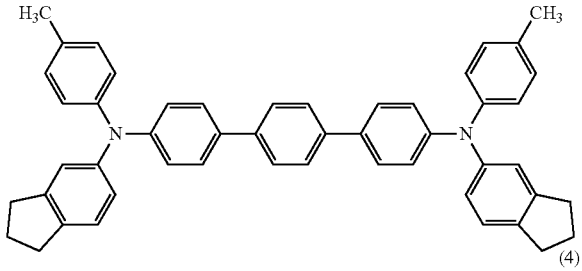

(4)

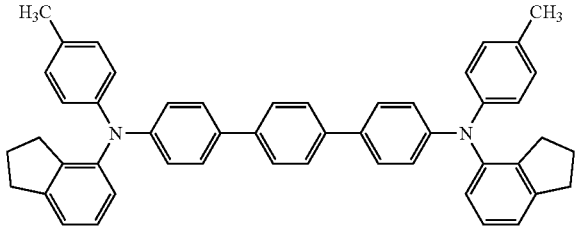

(5)

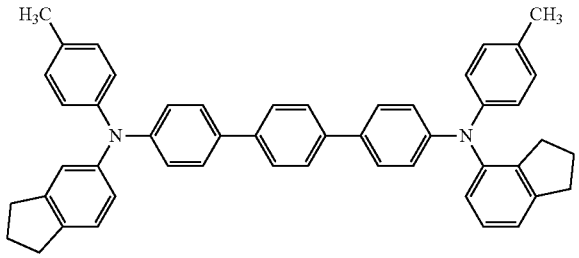

and an additive

In the preferred embodiment of the present invention, the additive comprises at least one selected from:

an organic phosphite compound represented by general formula (A1)

(A1)

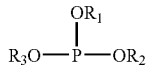

wherein $R_1$, $R_2$ and $R_3$ which may be the same or different represent a hydrogen atom, a substituted or unsubstituted alkyl group a substituted or unsubstituted alkenyl group or a substituted or unsubstituted aryl group, with the proviso that the case where $R_1$, $R_2$ and $R_3$ are all hydrogen atoms simultaneously is excluded;

a triphenylated phosphorus compound represented by general formula (A2)

(A2)

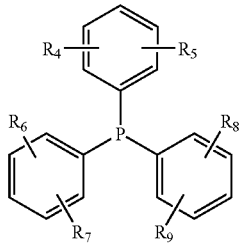

wherein $R_4$, $R_5$, $R_6$, $R_7$, $R_8$ and $R_9$ which may be the same or different represent a hydrogen atom, a halogen atom, a hydroxyl group a substituted or unsubstituted alkoxy group, a substituted or unsubstituted amino group or a substituted or unsubstituted alkyl group;

a thioether compound represented by general formula (A3)

$$R_{10}—S—R_{11} \quad (A3)$$

wherein $R_{10}$ and $R_{11}$ which may be the same or different represent a substituted or unsubstituted alkyl group, a substituted or unsubstituted alkenyl group or a substituted or unsubstituted aryl group;

a hydroquinone compound represented by general formula (A4)

(A4)

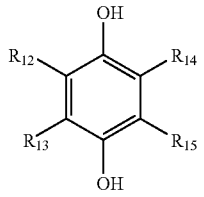

wherein $R_{12}$, $R_{13}$, $R_{14}$ and $R_{15}$ which may be the same or different represent a hydrogen atom, a substituted or unsubstituted alkyl group, a substituted or unsubstituted alkenyl group, a substituted or unsubstituted aryl group, a substituted or unsubstituted amino group, a substituted or unsubstituted arylthio group, a substituted or unsubstituted acyl group, a substituted or unsubstituted silyl group, a substituted or unsubstituted aryloxy group or a substituted or unsubstituted phosphino group;

a benzotriazole compound represented by general formula (A5)

(A5)

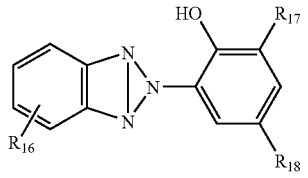

wherein $R_{16}$, $R_{17}$ and $R_{18}$ which may be the same or different represent a hydrogen atom, a halogen atom, a substituted or unsubstituted alkyl group, a substituted or unsubstituted alkenyl group or a substituted or unsubstituted aryl group;

a benzotriazole-alkylene bisphenol compound represented by general formula (A6)

(A6)

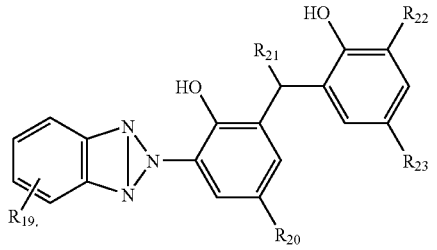

wherein $R_{19}$ represents a hydrogen atom, a halogen atom, a substituted or unsubstituted alkyl group, a substituted or unsubstituted cycloalkyl group, a substituted or unsubstituted alkoxy group or a substituted or unsubstituted aryl group, $R_{20}$ represents a substituted or unsubstituted alkyl group, a substituted or unsubstituted cycloalkyl group, a substituted or unsubstituted aryl group, a substituted or unsubstituted alkoxy group or a substituted or unsubstituted aralkyl group, $R_{21}$ represents a hydrogen atom, a substituted or unsubstituted alkyl group or a substituted or unsubstituted aryl group, and $R_{22}$ and $R_{23}$ which may be the same or different represent a substituted or unsubstituted alkyl group, a substituted or unsubstituted cycloalkyl group, a substituted or unsubstituted aryl group or a substituted or unsubstituted aryl group;

a hydroxybenzophenone compound represented by general formula (A7)

(A7)

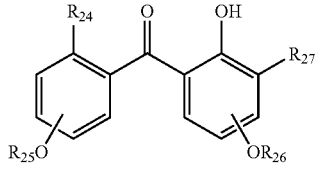

wherein $R_{24}$ represents a hydrogen atom or a hydroxyl group, $R_{25}$ and $R_{26}$ which may be the same or different represent a hydrogen atom, a substituted or unsubstituted alkyl group, a substituted or unsubstituted alkenyl group or a substituted or unsubstituted aryl group, and $R_{27}$ represents a hydrogen atom, a substituted or unsubstituted alkyl group or a substituted or unsubstituted aralkyl group;

a hindered phenol compound represented by general formula (A8)

(A8)

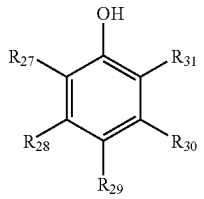

wherein $R_{27}$ represents a substituted or unsubstituted alkyl group, and $R_{28}$, $R_{29}$, $R_{30}$ and $R_{31}$ which may be the same or different represent a hydrogen atom, a substituted or unsubstituted alkyl group, a substituted or unsubstituted aryl group or a substituted or unsubstituted alkoxy group, or general formula (A9)

(A9)

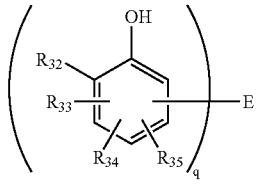

wherein $R_{32}$ represents a substituted or unsubstituted alkyl group, $R_{33}$, $R_{34}$ and $R_{35}$ which may be the same or different represent a hydrogen atom, a substituted or unsubstituted alkyl group or a substituted or unsubstituted alkoxy group, q is an integer of 2, 3 or 4, and E represents an oxygen atom, a sulfur atom or an aliphatic divalent group when q is 2, represents an aliphatic trivalent group or an aromatic trivalent group when q is 3, and represents an aliphatic tetravalent group when q is 4;

a hindered amine compound represent ad by general formula (A10)

(A10)

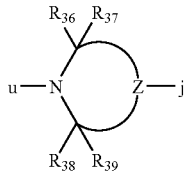

wherein $R_{36}$, $R_{37}$, $R_{38}$ and $R_{39}$ which may be the same or different represent a hydrogen atom, a substituted or unsubstituted alkyl group or a substituted or unsubstituted aryl group, Z represents an atomic group necessary to form a nitrogen-containing heterocycle, wherein in the pair of $R_{36}$ and $R_{37}$ and the pair of $R_{38}$ and $R_{39}$, one of them may be incorporated into Z to form a double bond, u represents a hydrogen atom, an oxygen atom, a substituted or unsubstituted alkyl group or a substituted or unsubstituted acyl group, and j represents a hydroxyl group a substituted or unsubstituted acyloxy group, a substituted or unsubstituted benzoyl group or other organic residues; and a salicylate compound represented by general formula (A11)

(A11)

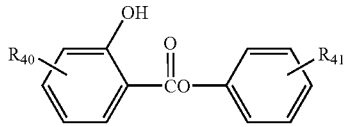

wherein $R_{40}$ and $R_{41}$ which may be the same or different represent a hydrogen atom, a substituted or unsubstituted alkyl group, a substituted or unsubstituted alkenyl group or a substituted or unsubstituted aryl group; and wherein the layer contains the additive in an amount of from 0.05 to 30 mass % based on the p-terphenyl compound.

The electrophotographic photosensitive body of the present invention has a photosensitive layer containing at least one p-terphenyl compound and further containing at least one additives.

The present invention can provide an electrophotographic photosensitive body which shows little change in charged potential and residual potential and which is excellent in durability by using in combination a p-terphenyl compound having a specific structure as a charge transport agent and a compound having a specific structure as an additive.

Figure 1:
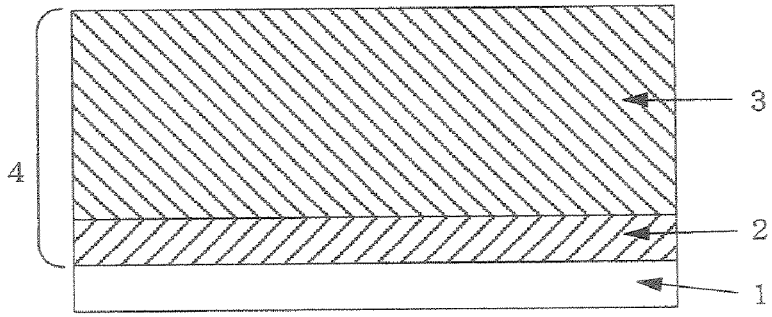
FIG. 1 is a schematic sectional view showing a layer structure of a functional separation type electrophotographic photosensitive body.

The reference numerals used in the drawings are as follows.

1: Conductive support
2: Charge generating layer
3: Charge transport layer
4: Photosensitive layer
5: Undercoat layer
6: Charge transport substance-containing layer
7: Charge generating substance
8: Protective layer

BEST MODE FOR CARRYING OUT THE INVENTION

The charge transport agent includes the p-terphenyl compound of the compounds (1) to (5).

Various embodiments of a photosensitive layer are present, and the photosensitive layer used in the electrophotographic photosensitive body of the present invention may be any of those. Such photosensitive bodies are shown in FIGS. 1 to 7 as the representative examples.

Figure 2:
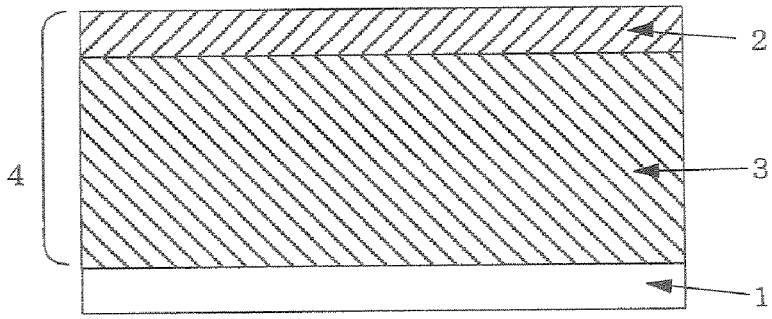
FIG. 2 is a schematic sectional view showing a layer structure of a functional separation type electrophotographic photosensitive body.
Figure 3:
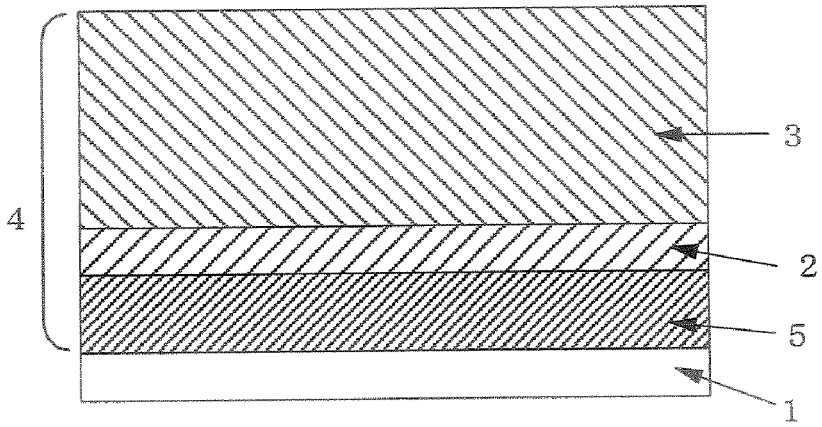
FIG. 3 is a schematic sectional view showing a layer structure of a functional separation type electrophotographic photosensitive body having an undercoat layer provided between a charge generating layer and a conductive support.
Figure 4:
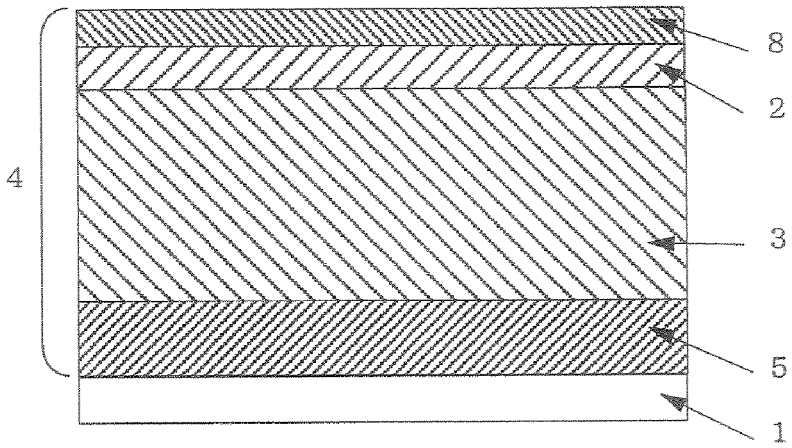
FIG. 4 is a schematic sectional view showing a layer structure of a functional separation type electrophotographic photosensitive body having an undercoat layer provided between a charge transport layer and a conductive support and having a protective layer on a charge generating layer.
Figure 5:
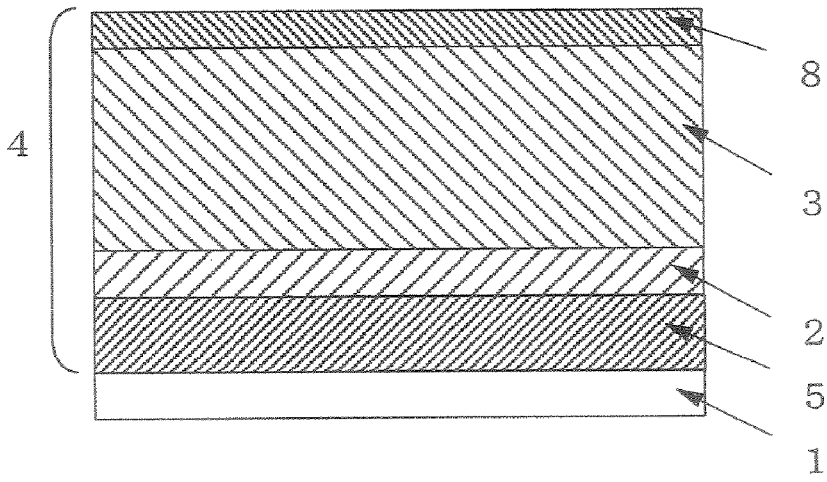
FIG. 5 is a schematic sectional view showing a layer structure of a functional separation type electrophotographic photosensitive body having an undercoat layer provided between a charge generating layer and a conductive support and having a protective layer on a charge transport layer.
Figure 6:
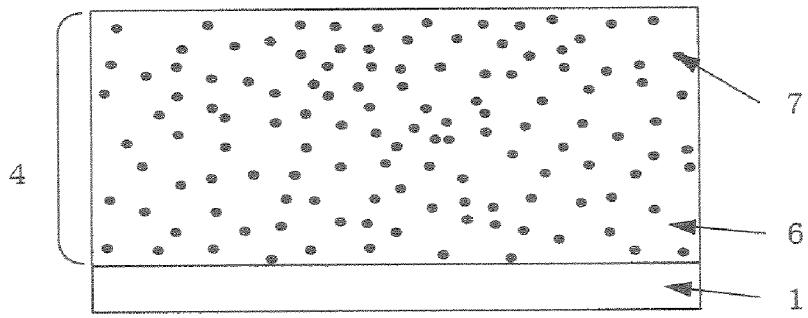
FIG. 6 is a schematic sectional view showing a layer structure of a single layer electrophotographic photosensitive body.
Figure 7:
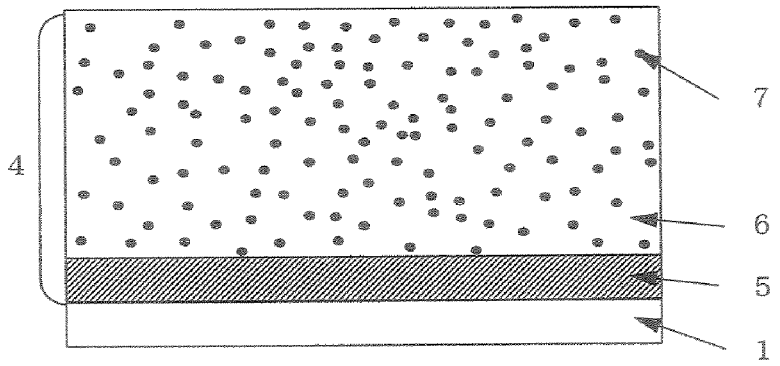
FIG. 7 is a schematic sectional view showing a layer structure of a single layer electrophotographic photosensitive body having an undercoat layer provided between a photosensitive layer and a conductive support.

FIGS. 1 and 2 shows a structure comprising a conductive support 1 having provided thereon a photosensitive layer 4 comprising a Saminate of a charge generating layer 2 comprising a charge generating substance as a main component and a charge transport layer 3 comprising a charge transport substance and a binder resin as main components. In this embodiment, as shown in FIGS. 3, 4 and 5, the photosensitive layer 4 may be provided through an undercoat layer 5 for adjusting charges provided on the conductive support, and a protective layer 8 may be provided as an outermost layer. Further, in the present invention, as shown in FIGS. 6 and 7, the photosensitive layer 4 comprising a charge generating substance 7 dissolved or dispersed in a layer 6 comprising a charge transport substance and a binder resin as main components may be provided on the conductive support 1 directly or through the undercoat layer 5.

The photosensitive body of the present invention can be prepared according to the conventional method as follows. For example, at least one p-terphenyl compound selected from the compounds (1) to (5) and at least one additive selected from the general formulae (A1) to (A11) are dissolved in an appropriate solvent together with a binder resin, and according to need, charge generating substances, electron withdrawing compounds, plasticizers, pigments and the like are added, thereby preparing a coating liquid This coating liquid is applied to the conductive support and dried to form a photosensitive layer of from several μm to several tens μm. Thus, a photosensitive body can e produced. When the photosensitive layer comprises two layers of a charge generating layer and a charge transport layer, the photosensitive layer can be prepared as follow. At least one p-terphenyl compound selected from the compounds (1) to (5) and at least one additive selected from the general formulae (A1) to (A11) are dissolved in an appropriate solvent together with a binder resin, and plasticizers, pigments and the like are added thereto, thereby preparing a coating liquid, and the coating liquid thus prepared is applied to the charge generating layer, or a charge transport layer is obtained by applying the coating liquid, and a charge generating layer is then formed on the charge transport layer According to need, the photosensitive body thus prepared may be provided with an undercoat layer and a protective layer.

The p-terphenyl compound of the compounds (1) to (5) can be synthesized by, for example, condensation reaction such as Ullmann reaction of 4,4"-diiodo-p-terphenyl or 4,4"-dibromo-p-terphenyl and the corresponding amino compound The corresponding amino compound can be synthesized by, for example, condensation reaction such as Ullmann reaction of aminoindane and p-iodotoluene or p-bromotoluene, and condensation reaction such as Ullmann reaction of the corresponding aniline derivatives and the corresponding iodobenzene derivatives or the corresponding bromobenzene derivatives. The aminoindane can be synthesized by, for example, amination (for example, see Non-Patent Document 2) after passing halogenation (for example, see Non-Patent Document 1) of indane.

Non-Patent Document 1: *Jikken Kagaku Koza* (4th edition, The Chemical Society of Japan) pages 19 and 363 to 482

Non-Patent Document 2: *Jikken Kagaku Koza* (4th edition, The Chemical Society of Japan) pages 20 and 279 to 318

Each constituent used in the present invention is as follows. Specific examples of the additive represented by the general formulae (A1) to (A11) are described below, but the invention is not limited to those.

TABLE 1-(1)

| Organic phosphite compound represented by the general formula (A1) | |
|---|---|
| Number | Structural formula |
| 1-(1) | $P(OCH_3)_3$ |
| 1-(2) | $P(OC_2H_5)_3$ |
| 1-(3) | $P(OC_4H_9)_3$ |
| 1-(4) | $P(OC_{10}H_{21})_3$ |
| 1-(5) | $P(OC_{12}H_{25})_3$ |
| 1-(6) | $P(OC_{18}H_{37})_3$ |
| 1-(7) | 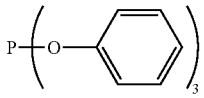 |
| 1-(8) | 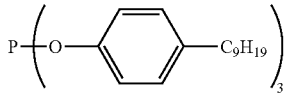 |
| 1-(9) | 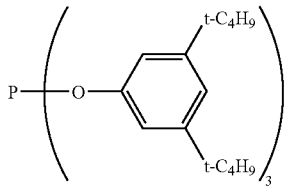 |
| 1-(10) | 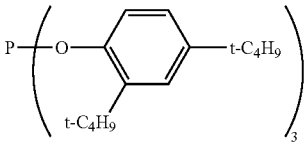 |
| 1-(11) | 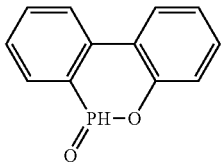 |

TABLE 1-(2)
| Organic phosphite compound represented by the general formula (A1) | |
|---|---|
| Number | Structural formula |
| 1-(12) | 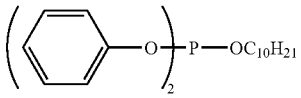 |
| 1-(13) | 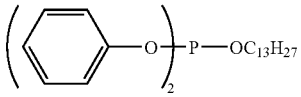 |
| 1-(14) | 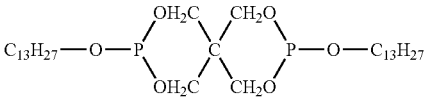 |
| 1-(15) | 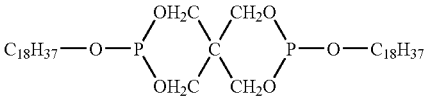 |
| 1-(16) | 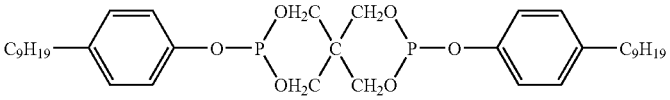 |
| 1-(17) | 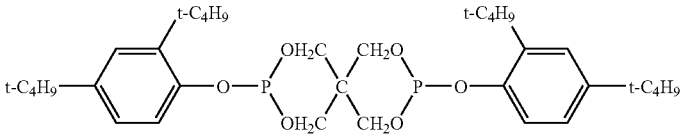 |
| 1-(18) | 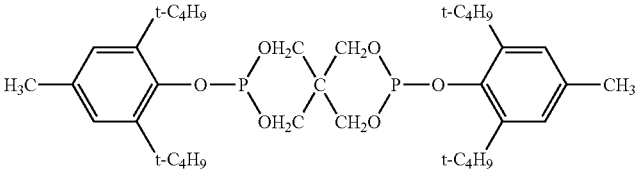 |
| 1-(19) | 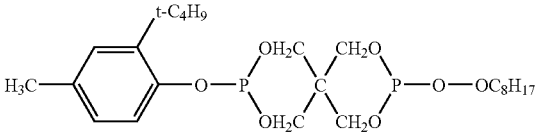 |
| 1-(20) | 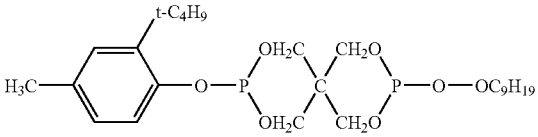 |
| 1-(21) | 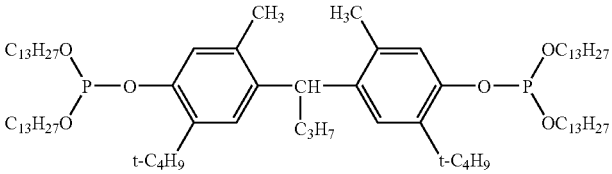 |

TABLE 1-(2)-continued

| Organic phosphite compound represented by the general formula (A1) | |
|---|---|
| Number | Structural formula |
| 1-(22) | 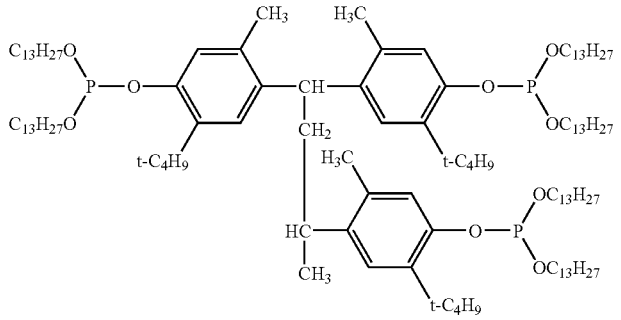 |

TABLE 2

| Triphenylated phosphorus compound represented by the general formula (A2) | |
|---|---|
| Number | Structural formula |
| 2-(1) | 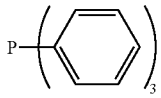 |
| 2-(2) | 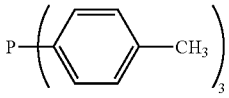 |
| 2-(3) | 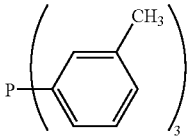 |
| 2-(4) | 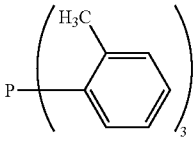 |
| 2-(5) | 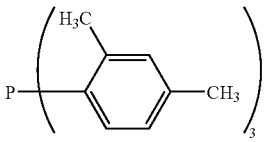 |
| 2-(6) | 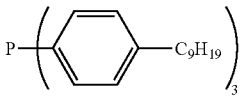 |
| 2-(7) | 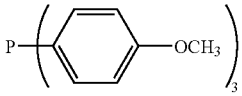 |

TABLE 2-continued

| Triphenylated phosphorus compound represented by the general formula (A2) | |
|---|---|
| Number | Structural formula |
| 2-(8) | 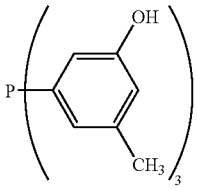 |

TABLE 3

| Thioether compound represented by the general formula (A3) | |
|---|---|
| Number | Structural formula |
| 3-(1) | $S(C_8H_{17})_2$ |
| 3-(2) | $S(C_{12}H_{25})_2$ |
| 3-(3) | $S(C_{16}H_{33})_2$ |
| 3-(4) | $S(CH_2CH_2COOH)_2$ |
| 3-(5) | $S(CH_2CH_2COOC_8H_{17})_2$ |
| 3-(6) | $S(CH_2CH_2COOC_{12}H_{25})_2$ |
| 3-(7) | $S(CH_2CH_2COOC_{13}H_{27})_2$ |
| 3-(8) | $S(CH_2CH_2OCOC_{13}H_{27})_2$ |
| 3-(9) | $S(CH_2CH_2COOC_{14}H_{29})_2$ |
| 3-(10) | $S(CH_2CH_2COOC_{18}H_{37})_2$ |

TABLE 3-continued

| Thioether compound represented by the general formula (A3) | |
|---|---|
| Number | Structural formula |
| 3-(11) | 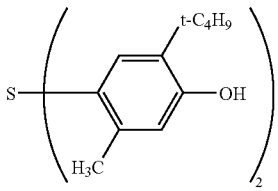 |
| 3-(12) | 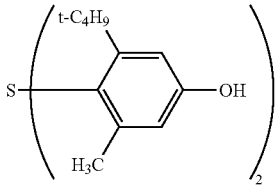 |

TABLE 4-(1)

| Hydroquinone compound represented by the general formula (A4) | |
|---|---|
| Number | Structural formula |
| 4-(1) | 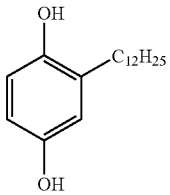 |
| 4-(2) | 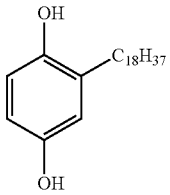 |
| 4-(3) | 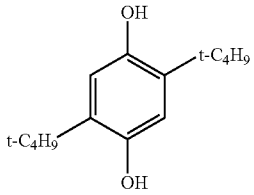 |
| 4-(4) | 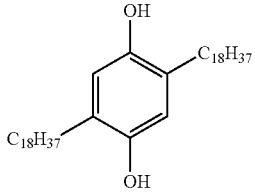 |

TABLE 4-(1)-continued

| Hydroquinone compound represented by the general formula (A4) | |
|---|---|
| Number | Structural formula |
| 4-(5) | 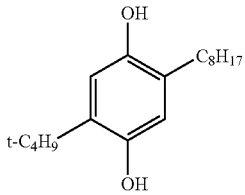 |
| 4-(6) | 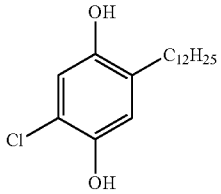 |
| 4-(7) | 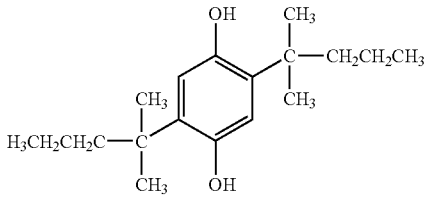 |
| 4-(8) | 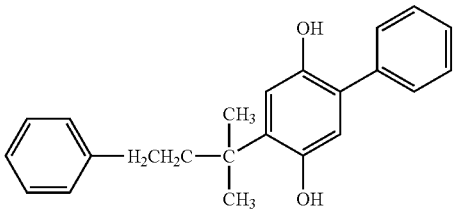 |
| 4-(9) | 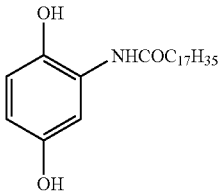 |

TABLE 4-(2)

| Hydroquinone compound represented by the general formula (A4) | |
|---|---|
| Number | Structural formula |
| 4-(10) | 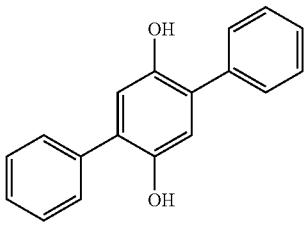 |

TABLE 4-(2)-continued
| Hydroquinone compound represented by the general formula (A4) | |
|---|---|
| Number | Structural formula |
| 4-(11) | 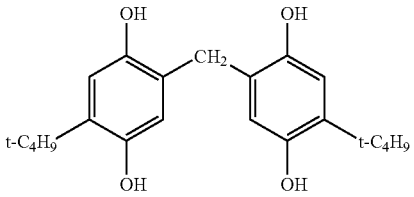 |
| 4-(12) | 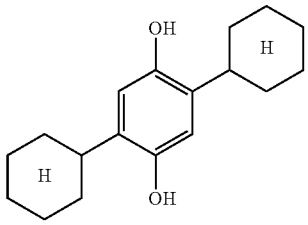 |
| 4-(13) | 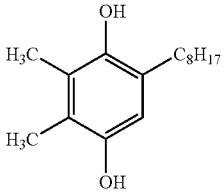 |
| 4-(14) | 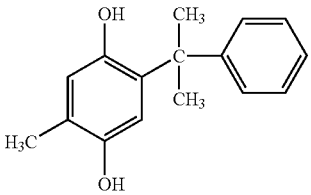 |
| 4-(15) | 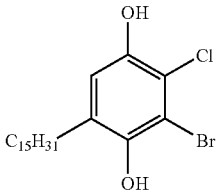 |
| 4-(16) | 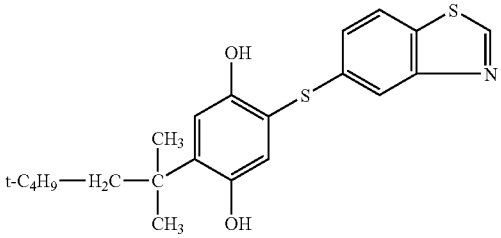 |
| 4-(17) | 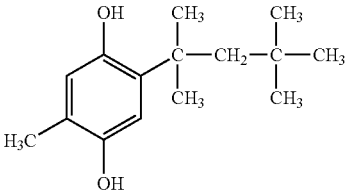 |
TABLE 4-(3)
| Hydroquinone compound represented by the general formula (A4) | |
|---|---|
| Number | Structural formula |
| 4-(18) | 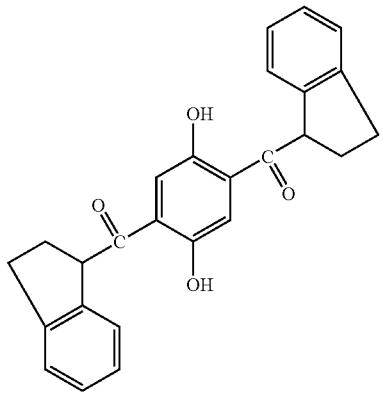 |
| 4-(19) | 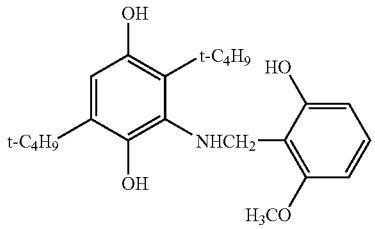 |
| 4-(20) | 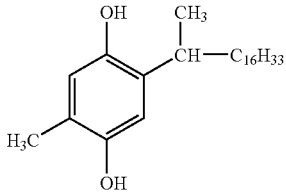 |
| 4-(21) | 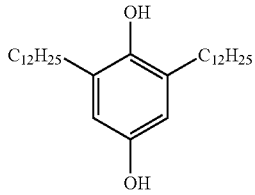 |
| 4-(22) | 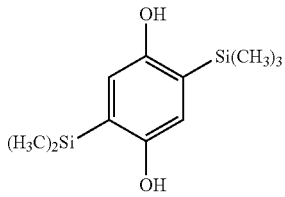 |
| 4-(23) | 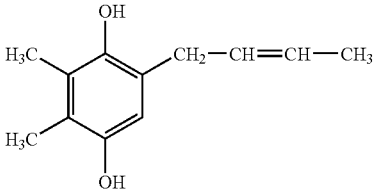 |

TABLE 4-(3)-continued

| Hydroquinone compound represented by the general formula (A4) | |
|---|---|
| Number | Structural formula |
| 4-(24) | 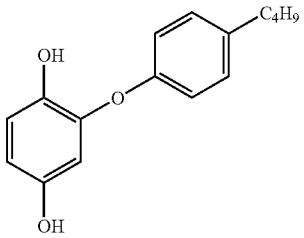 |

TABLE 4-(4)

| Hydroquinone compound represented by the general formula (A4) | |
|---|---|
| Number | Structural formula |
| 4-(25) | 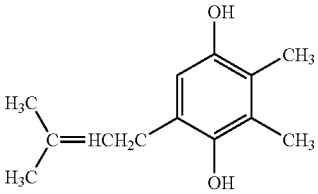 |
| 4-(26) | 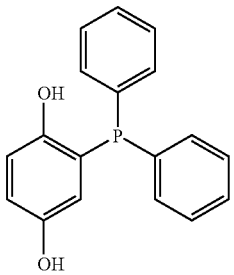 |
| 4-(27) | 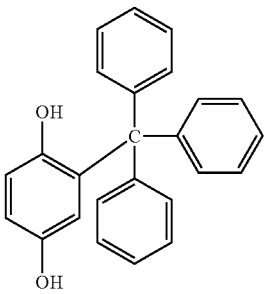 |
| 4-(28) | 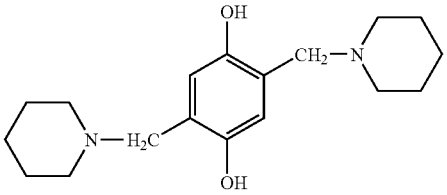 |

TABLE 4-(4)-continued

| Hydroquinone compound represented by the general formula (A4) | |
|---|---|
| Number | Structural formula |
| 4-(29) | 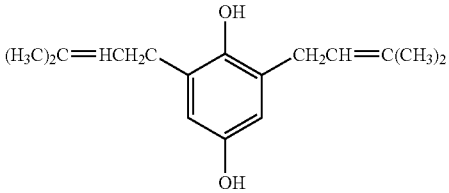 |
| 4-(30) | 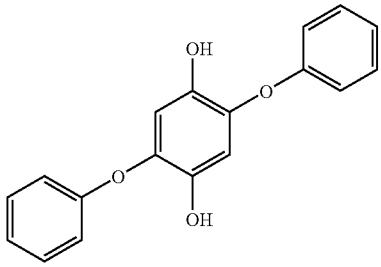 |
| 4-(31) | 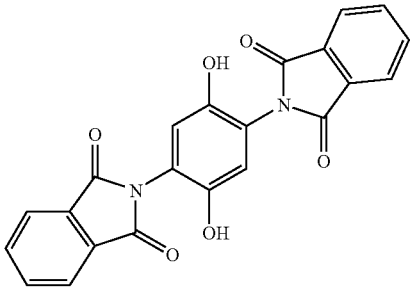 |
| 4-(32) | 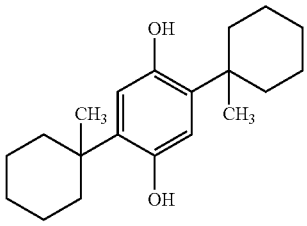 |

TABLE 5-(1)

| Benzotriazole compound represented by the general formula (A5) | |
|---|---|
| Number | Structural formula |
| 5-(1) | 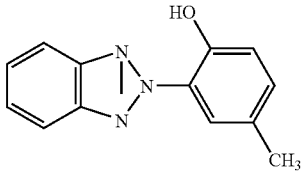 |

TABLE 5-(1)-continued
| Benzotriazole compound represented by the general formula (A5) | |
|---|---|
| Number | Structural formula |
| 5-(2) | 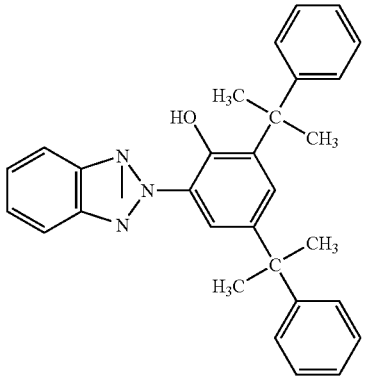 |
| 5-(3) | 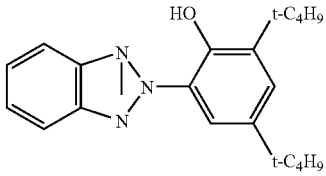 |
| 5-(4) | 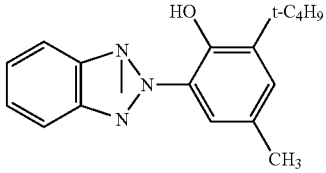 |
| 5-(5) | 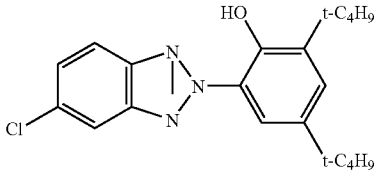 |
| 5-(6) | 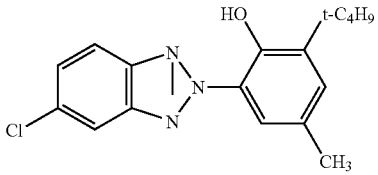 |
| 5-(7) | 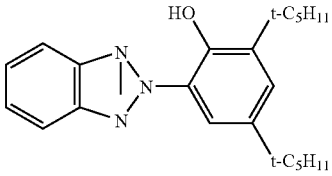 |
| 5-(8) | 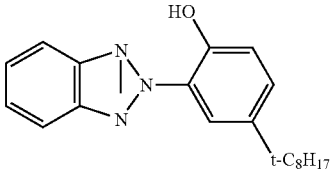 |
TABLE 5-(2)
| Benzotriazole compound represented by the general formula (A5) | |
|---|---|
| Number | Structural formula |
| 5-(9) | 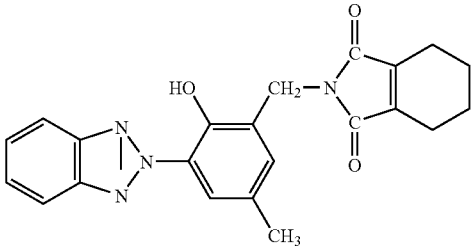 |
| 5-(10) | 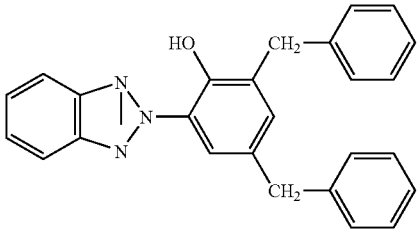 |
| 5-(11) | 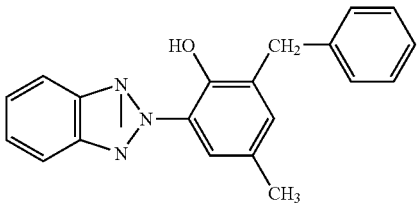 |
| 5-(12) | 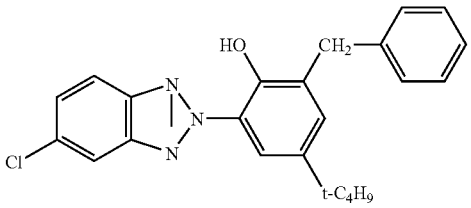 |
TABLE 6-(1)
| Benzotriazole-alkylene bisphenol compound represented by the general formula (A6) | |
|---|---|
| Number | Structural formula |
| 6-(1) | 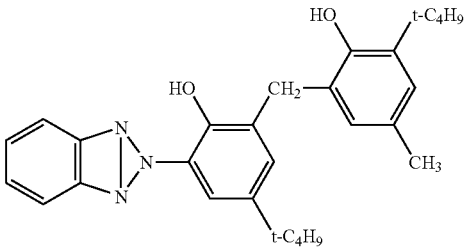 |

TABLE 6-(1)-continued

| Benzotriazole-alkylene bisphenol compound represented by the general formula (A6) | |
|---|---|
| Number | Structural formula |
| 6-(2) | 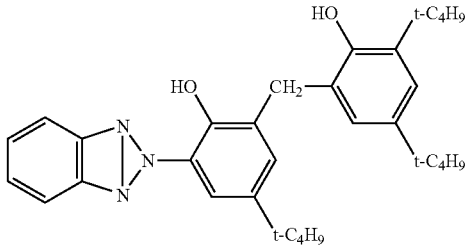 |
| 6-(3) | 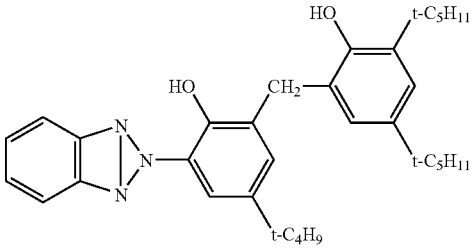 |
| 6-(4) | 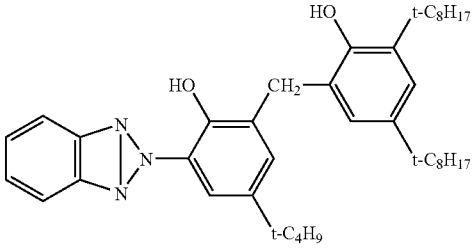 |
| 6-(5) | 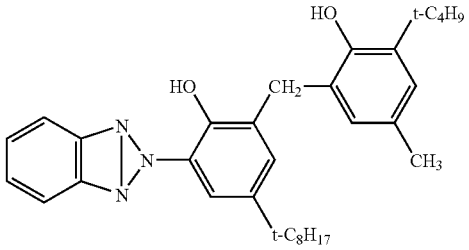 |
| 6-(6) | 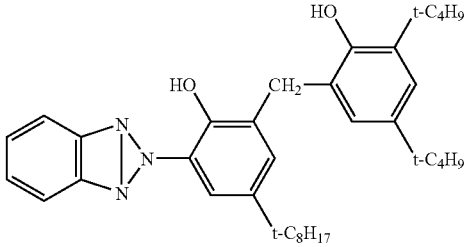 |
| 6-(7) | 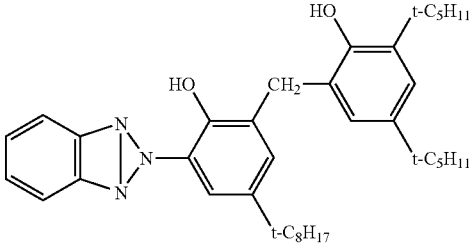 |

TABLE 6-(1)-continued

| Benzotriazole-alkylene bisphenol compound represented by the general formula (A6) | |
|---|---|
| Number | Structural formula |
| 6-(8) | 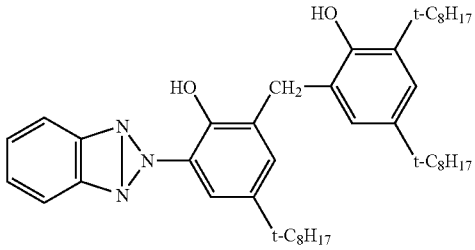 |

TABLE 6-(2)

| Benzotriazole-alkylene bisphenol compound represented by the general formula (A6) | |
|---|---|
| Number | Structural formula |
| 6-(9) | 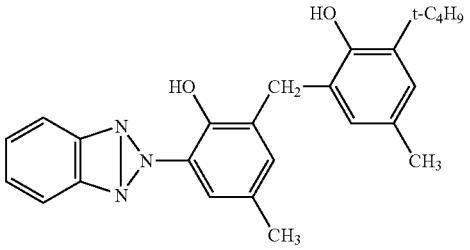 |
| 6-(10) | 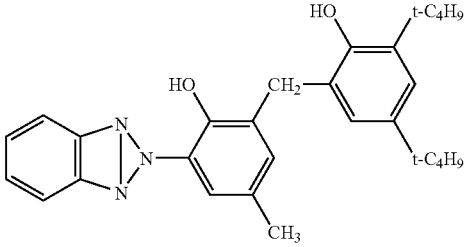 |
| 6-(11) | 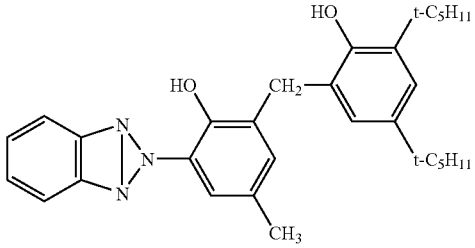 |
| 6-(12) | 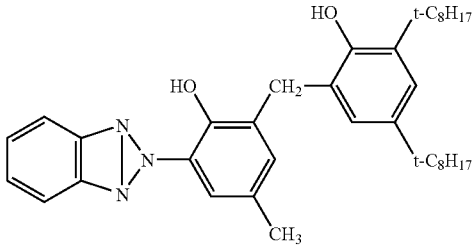 |

TABLE 7
| Hydroxybenzophenone compound represented by the general formula (A7) | |
|---|---|
| Number | Structural formula |
| 7-(1) | 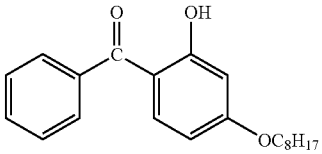 |
| 7-(2) | 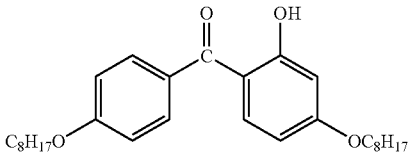 |
| 7-(3) | 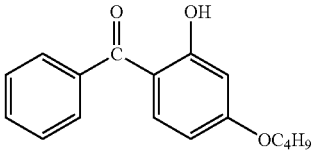 |
| 7-(4) | 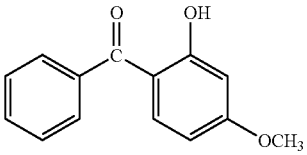 |
| 7-(5) | 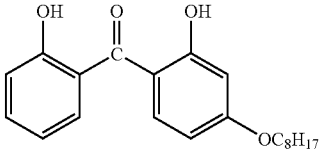 |
| 7-(6) | 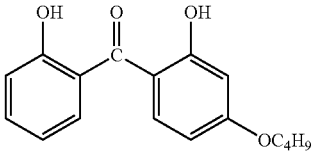 |
| 7-(7) | 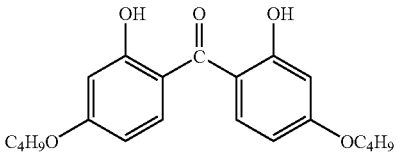 |
| 7-(8) | 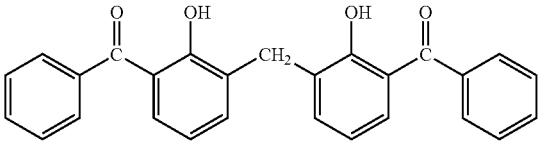 |
| 7-(9) | 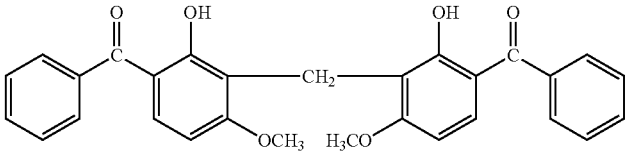 |

TABLE 8-(1)
| Hindered phenol compound represented by the general formulae (A8, A9) | |
|---|---|
| Number | Structural formula |
| 8-(1) | 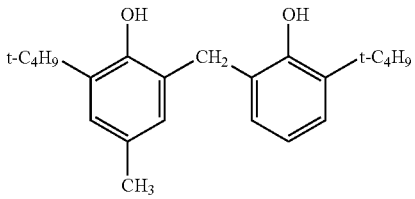 |
| 8-(2) | 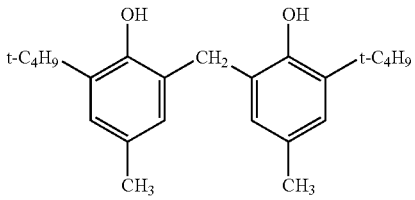 |
| 8-(3) | 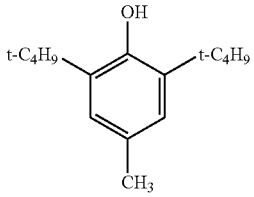 |
| 8-(4) | 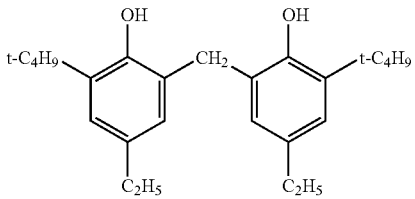 |
| 8-(5) | 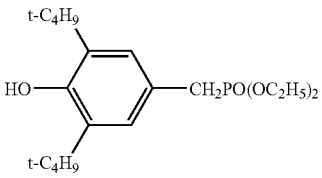 |
| 8-(6) | 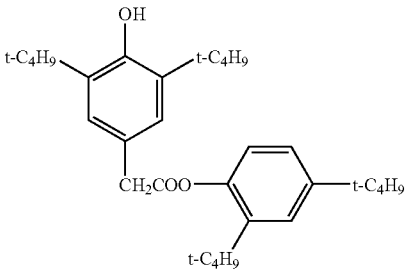 |
| 8-(7) | 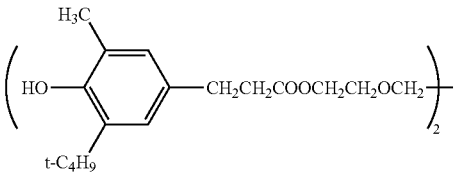 |
TABLE 8-(1)-continued
| Hindered phenol compound represented by the general formulae (A8, A9) | |
|---|---|
| Number | Structural formula |
| 8-(8) | 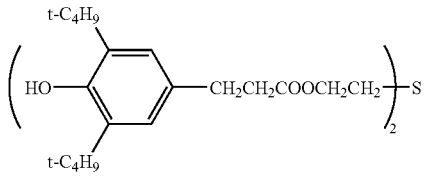 |
| 8-(9) | 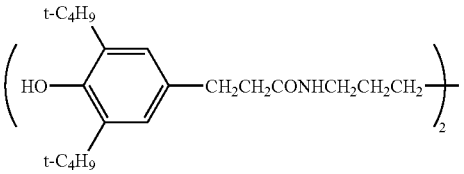 |
TABLE 8-(2)
| Hindered phenol compound represented by the general formulae (A8, A9) | |
|---|---|
| Number | Structural formula |
| 8-(10) | 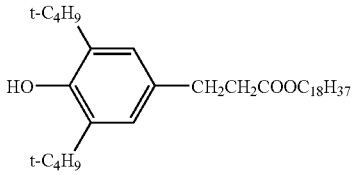 |
| 8-(11) | 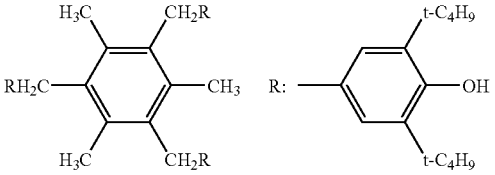 |
| 8-(12) | 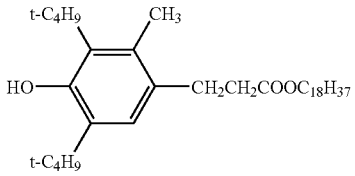 |
| 8-(13) | 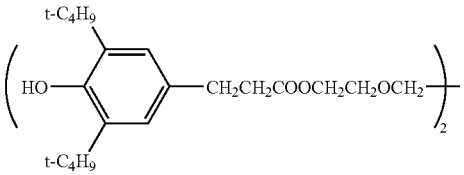 |
| 8-(14) | 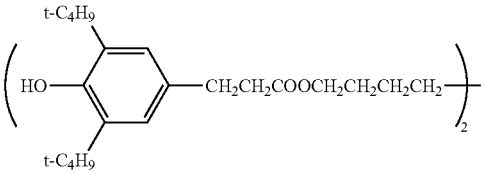 |

TABLE 8-(2)-continued
| Hindered phenol compound represented by the general formulae (A8, A9) | |
|---|---|
| Number | Structural formula |
| 8-(15) | 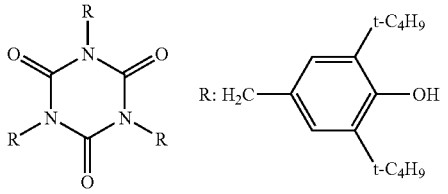 |
| 8-(16) | 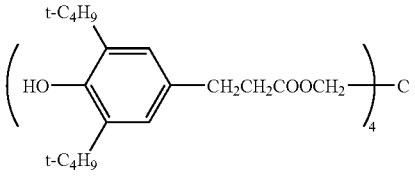 |
TABLE 8-(2)-continued
| Hindered phenol compound represented by the general formulae (A8, A9) | |
|---|---|
| Number | Structural formula |
| 8-(18) | 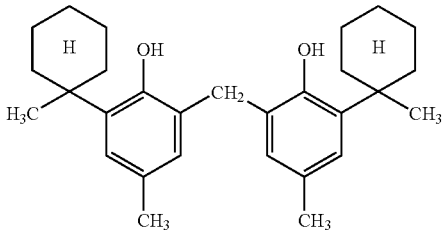 |
TABLE 9-(1)
| Hindered amine compound represented by the general formulae (A10) | |
|---|---|
| Number | Structural formula |
| 9-(1) | 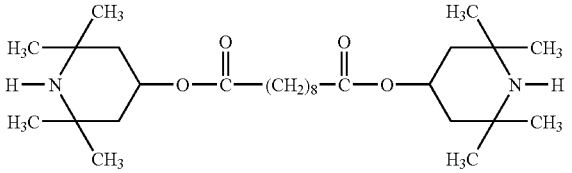 |
| 9-(2) | 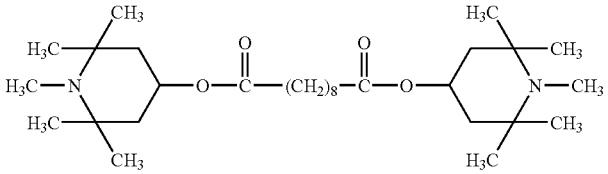 |
| 9-(3) | 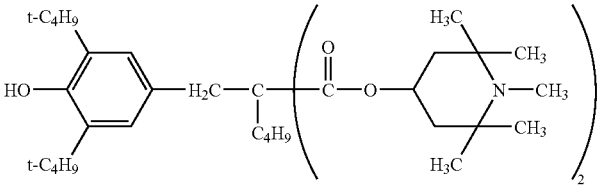 |
| 9-(4) | 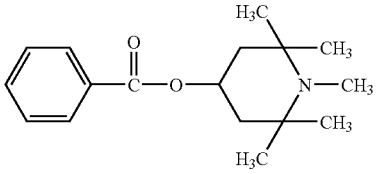 |
| 9-(5) | 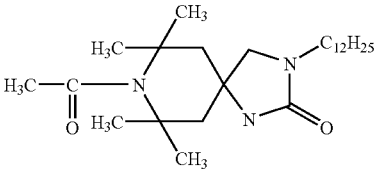 |

TABLE 9-(1)-continued
| Hindered amine compound represented by the general formulae (A10) | |
|---|---|
| Number | Structural formula |
| 9-(6) | 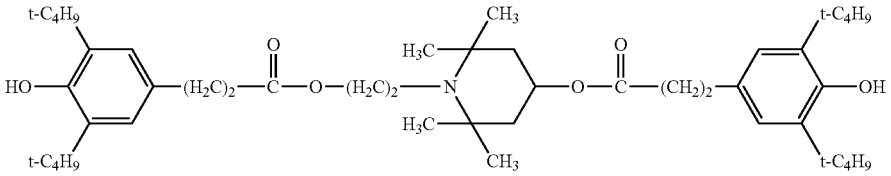 |
| 9-(7) | 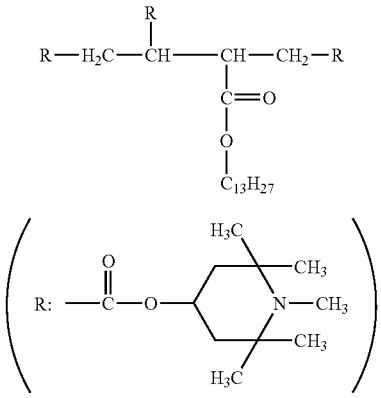 |
| 9-(8) | 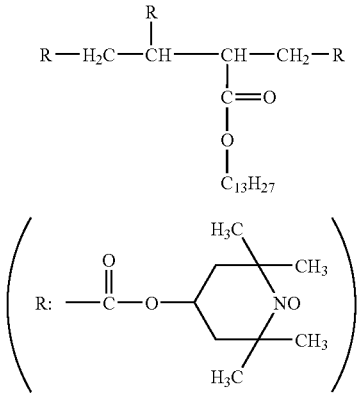 |
TABLE 9-(2)
| Hindered amine compound represented by the general formulae (A10) | |
|---|---|
| Number | Structural formula |
| 9-(9) | 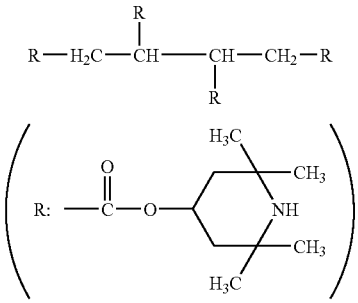 |

TABLE 9-(2)-continued

| Hindered amine compound represented by the general formulae (A10) | |
|---|---|
| Number | Structural formula |
| 9-(10) | 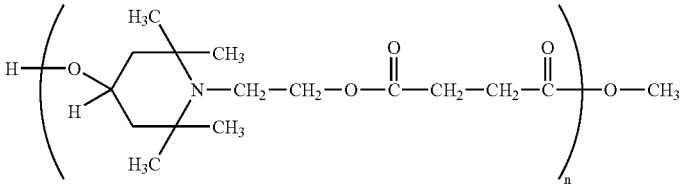 |

TABLE 10

| Salicylate compound represented by the general formulae (A11) | |
|---|---|
| Number | Structural formula |
| 10-(1) | 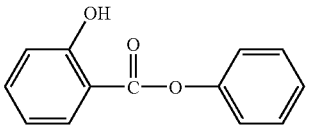 |
| 10-(2) | 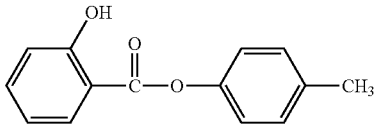 |
| 10-(3) | 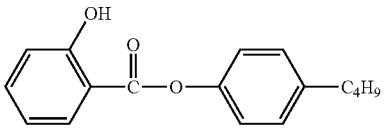 |
| 10-(4) | 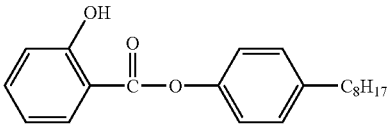 |
| 10-(5) | 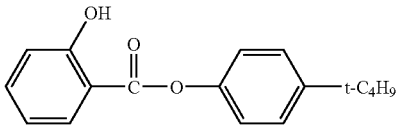 |
| 10-(6) | 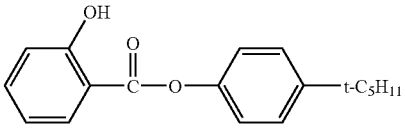 |

A proportion of the additive used in the photosentstive body of the present invention is from 0.05 to 30 mass % based on the p-terphenyl compound The preferable use amount is the case that the proportion of the additive is from 0.1 to 20 mass % based on the p-terphenyl compound.

The conductive support on which the photosensitive layer of the present invention is formed can use the materials used in the conventional electrophotographic photosensitive bodies. Examples of the conductive support that can be used include metal drums or sheets of aluminum, aluminum alloy, stainless steel, copper, zinc, vanadium, molybdenum, chromium, titanium, nickel, indium, gold, platinum or the like; laminates or depositions of those metals; plastic films, plastic drums, papers or paper cores, obtained by applying conductive substances such as metal powder, carbon black, copper iodide and polymer electrolyte thereto together with an appropriate binder to conduct conducting treatment; and plastic films or plastic drums, obtained by containing conductive substances therein to impart conductivity.

Further, according to need, an undercoat layer comprising a resin, or a resin and a pigment may be provided between the conductive support and the photosensitive layer. The pigment dispersed in the undercoat layer may be a powder generally used, but is desirably a while pigment that does not substantially absorb near infrared light or the similar pigment when high sensitization is considered. Examples of such a pigment include metal oxides represented by titanium oxide, zinc oxide, tin oxide, indium oxide, zirconium oxide, alumina and silica. The metal oxides that do not have hygroscopic properties and have less environmental change are desirable.

Further, as a resin used in the undercoat layer, resins having high solvent resistance to general organic solvents are desirable, considering that a photosensitive layer is applied to the undercoat layer, using a solvent. Examples of such a resin include water-soluble resins such as polyvinyl alcohol, casein and sodium polyacrylate; alcohol-soluble resins such as copolymer nylon and methoxymethylated nylon; and curing resins that form a three-dimensional network structure such as polyurethane, melamine resin and epoxy resin.

The charge generating layer in the present invention comprises a charge generating agent, a binder resin, and additives added according to need, and its production method includes a coating method, a deposition method and a CVD method.

Examples of the charge generating agent include phthalocyanine pigments such as various crystal titanyl phthalocyanines, titanyl phthalocyanine having strong peaks of a diffraction angle $2\theta \pm 0.2°$ in X-ray diffraction spectrum of Cu—Kα at 9.3, 10.6, 13.2, 15.1, 20.8, 23.3 and 26.3, titanyl phthalocyanine having strong peaks of a diffraction angle $2\theta \pm 0.2°$ at 7.5, 10.3, 12.6, 22.5, 24.3, 25.4 and 28.6, titanyl phthalocyanine having strong peaks of a diffraction angle $2\theta \pm 0.2°$ at 9.6, 24.1 and 27.2, various crystal metal-free phthalocyanine such as τ type and X type, copper phthalocyanine, aluminum phthalocyanine, zinc phthalocyanine, α type, β type and Y type oxotitanyl phthalocyanines, cobalt phthalocyanine, hydroxygallium phthalocyanine, chloroaluminum phthalocyanine, and chloroindium phthalocyanine; azo pigments such as azo pigment having triphenylamine skeleton (for example, see Patent Document 3), azo pigment having carbazole skeleton (for example, see Patent Document 4), azo pigment having fluorene skeleton (for example, see Patent Document 5), azo pigment having oxadiazole skeleton (for example, see Patent Document 6), azo pigment having bisstylbene skeleton (for example, see Patent Document 7), azo pigment having dibenzothiophene skeleton (for example, see Patent Document 8), azo pigment having distyrylbenzene skeleton (for example, see Patent Document 9), azo pigment having distyrylcarbazole skeleton (for example, see Patent Document 10), azo pigment having distyryloxadiazole skeleton (for example, see Patent Document 11), azo pigment having stylbene skeleton (for example, see Patent Document 12), trisazo pigment having carbazole skeleton (for example, see Patent Documents 13 and 14), azo pigment having anthraquinone skeleton (for example, see Patent Document 15), and bisazo pigment having diphenylpolyene skeleton (for example, see Patent Document 16 to 20); perylene pigments such as peryleic anhydride and peryleic imide; polycyclic quinine pigments such as anthraquinone derivative, anthanthrone derivative, dibenzpyrenequinone derivative, pyranthrone derivative, violanthrone derivative and iso-violanthrone; diphenylmethane and triphenylmethane pigments; cyanine an azomethine pigments; indigo pigments; bisbenzimidazole pigments; azulenium salts; pyrylium salts; thiapyrylium salts; benzopyrylium salts; and squarylium salts. Those may be used alone or as mixtures of two or more thereof according to need.

Patent Document 3: JP-A-53-132347
Patent Document 4: JP-A-53-95033
Patent Document 5: JP-A-54-22834
Patent Document 6: JP-A-54-12742
Patent Document 7: JP-A-54-17733
Patent Document 8: JP-A-54-21728
Patent Document 9: JP-A-53-133445
Patent Document 10: JP-A-54-17734
Patent Document 11: JP-A-54-2129
Patent Document 12: JP-A-53-138229
Patent Document 13: JP-A-57-195767
Patent Document 14: JP-A-57-105768
Patent Document 15: JP-A-57-202545
Patent Document 16: JP-A-59-129857
Patent Document 17: JP-A-62-267363
Patent Document 18: JP-A-64-79753
Patent Document 19: JP-B-3-34503
Patent Document 20: JP-B-4-52459

The binder resin in the charge generating layer is not particularly limited, and examples thereof include polycarbonate, polyarylate, polyester, polyamide, polyethylene, polystyrene, polyacrylate, polymethacrylate, polyvinyl butyral, polyvinyl acetal, polyvinyl formal, polyvinyl alcohol, polyacrylonitrile, polyacrylamilde, styrene-acryl copolymer, styrene-maleic anhydride copolymer, acrylonitrile-butadiene copolymer, polysulfone, polyether sulfone, silicon resin and phenoxy resin. Those may be used alone or as mixtures of two or more thereof according to need.

The additives used according to need include antioxidants, ultraviolet absorbers, light stabilizers, dispersing agents, pressure-sensitive adhesives, and sensitizers. The charge generating layer prepared using the above materials has a film thickness of from 0.1 to 2.0 μm, and preferably from 0.1 to 1.0 μm. The charge transport layer in the present invention can be formed by dissolving a charge transport agent, a binder resin and according to need, an electron accepting substance and additives in a solvent, applying the resulting solution to the charge generating layer, the conductive support or the undercoat layer, and drying.

Examples of materials used as a binder resin in the charge transport layer include polymers or copolymers of a vinyl compound such as styrene, vinyl acetate, vinyl chloride, acrylic ester, methacrylic ester and butadiene, and various resins having compatibility with the charge transport layer and the additive, such as polyvinyl acetal, polycarbonate for example, see Patent Documents 21 to 24), polyester, polyphenylene oxide, polyurethane cellulose ester, phenoxy resin, silicon resin and epoxy resin. Those may be used alone or as mixtures of two or more thereof according to need. Amount of the binder resin used is generally from 0.4 to 10 mass times, and preferably from 0.5 to 5 mass times, the charge transport agent Specific examples of the particularly effective resin include polycarbonate resins such as IUPILON, a product of Mitsubishi Engineering-Plastics Corporation and bisphenol A-biphenol copolycarbonate (a product of Idemitsu Kosan Co., Ttd Patent Document 21: JP-A-60-172044
Patent Document 22: JP-A-62-247374
Patent Document 23: JP-A-63-148263
Patent Document 21: JP-A-2-254459

The solvent used for the charge transport layer is not particularly limited so long as it dissolves a charge transport agent, a binder resin, an electron accepting substance and additives. Examples of the solvent that can be used include polar organic solvents such as tetrahydrofuran, 1,4-dioxane, methyl ethyl ketone, cyclohexanone, acetonitrile, N,N-dimethylformamide and ethyl acetate; aromatic organic solvents such as toluene, xylene and chlorobenzene; and chlorine-based hydrocarbon solvents such as chloroform, trichloroethylene, dichloromethane and 1,2-dichloroethane. Those may be used alone or as mixtures of two or more thereof according to need.

The photosensitive layer of the present invention can contain an electron accepting substance for the purpose of improvement of sensitivity, decrease of residual potential or reduction of fatigue when used repeatedly. Examples of the electron accepting substance include succinic anhydride, maleic anhydride, dibromosuccinic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene tetracyanoquinodlethane, o-dimitrobenzene, m-dinitrobenzene, 1,3,5-trinitrobenzene, p-nitrobenzonitrile, picryl chloride, quinonechloroimide, chioranil bromanil, dichlorodicyano-p-benzoquinone, anthraquinone, dinitroanthraquinone, 2,3-dichloro-1,4-naphthoquinone, 1-nitroanthraqulnone, 2-chloroanthraquinone, phenanthrenequinone, terephthalal malenonitrile, 9-anthrylmethylidene malenonitrile, 9-fluoronylidene malononitrile, polynitro-9-fluoronylidene malononitrile, 4-nitrobenzaldehyde, 9-benzoylanthracene, indanedione, 3,5-dinitrobenzophenone, 4-chloronaphthalic anhydride, 3-benzalphthalide, 3-(α-cyano-p-nitrobenzal)-4,5,6,7-tetrachlorophthalide, picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid and other compounds having large electron affinity.

According to need, a surface protective layer may be provided on the surface of the photosensitive body. Materials that can be used for the protective layer include resins such as polyester and polyamide, and mixtures of those resins and metals, metal oxides, and the like that can control electric resistance. The surface protective layer is desirable to be transparent as much as possible in a wavelength region of light absorption of the charge generating agent.

The present invention will be illustrated in greater detail with reference to the following Examples but the invention should not construed as being limited to those Examples. In the Examples, "part" means part by mass and "%" means "% by weight".

EXAMPLE 1

Synthesis Example 1

Synthesis of Compound (1)

11.5 g (0.063 mol) of phenyl-p-tolylamine, 14.5 g (0.030 mol) of 4,4"-diiodo-p-terphenyl, 5.0 g (0.036 mol) of anhydrous potassium carbonate, 0.38 g (0.006 mol) of a copper powder and 15 ml of n-dodecane were mixed, and while introducing a nitrogen gas, the resulting mixture was heated to 200 to 210° C. and stirred for 30 hours. After completion of the reaction, the reaction product was extracted with 400 ml of toluene, insoluble contents were removed by filtration, and the filtrate was concentrated to dryness. The solid obtained was purified with column chromatography (carrier:silica gel, elute:toluene:hexane=1:4) to obtain 136 g of N—N'-diphenyl-N,N'-di-p-tolyl-4,4"-diamino-p-terphenyl (compound (1)) (yield: 76.4%, melting point: 167.2 to 168.2).

It was identified as compound (1) by elementary analysis and IR measurement. Elementary analysis values are as follows. Carbon: 89.23% (89.15%), hydrogen: 6.14% (6.12%), and nitrogen: 4.60% (4.73%) (calculated values are shown in the parenthesis).

EXAMPLE 2

Synthesis Example 2

Synthesis of Compound (2)

14.1 g (0.066 mol) of (4-methoxy-2-methylphenyl)phenylamine, 14.5 g (0.030 mol) of 4,4"-diiodo-p-terphenyl, 5.0 g (0.036 mol) of anhydrous potassium carbonate, 0.38 g (0.006 mol) of a copper powder and 15 ml of n-dodecane were mixed, and while introducing a nitrogen gas, the resulting mixture was heated to 200 to 210° C. and stirred for 30 hours. After completion of the reaction, the reaction product was extracted with 400 ml of toluene, insoluble contents were removed by filtration, and the filtrate was concentrated to dryness. The solid obtained was purified with column chromatography (carrier:silica gel, elute:toluene:hexane=1:2) to obtain 15.7 g of N—N'-di(4-methoxy-2-methylphenyl)-N,N'-diphenyl-4,4"-diamino-p-terphenyl (compound (2)) (yield: 80.0%, melting point: 180.8 to 183.4° C).

It was identified as compound (2) by elementary analysis and IR measurement. Elementary analysis values are as follows. Carbon: 84.67% (84.63%), hydrogen: 6.23% (6.18%), and nitrogen: 4.26% (4.29%) calculated values are shown in the parenthesis).

EXAMPLE 3

Synthesis Example 3

Synthesis of Compound (3)

33.3 g (0.25 mol) of 5-aminoindane (a product of Tokyo Chemical Industry Co., Ltd.) was dissolved in 250 ml of glacial acetic acid, the resulting solution was heated to 50° C., and 51.0 g (0.5 mol) of acetic anhydride was added dropwise thereto. After completion of the dropwise additions the resulting solution was stirred for 4 hours. After completion of the reaction, the reaction liquid was poured in 1,500 ml of ice water while stirring. Crystals precipitated were filtered off and washed with 1,000 ml of water The crystals obtained were dried to obtain 37.06 g of 5-(N-acetylamino)indane (yield: 84.6%, melting point: 100.5 to 103-85° C.)

26.28 g (0.15 mol) of 5-(N-acetylamino)indane, 43.61 g (0.20 mol) of p-iodotoluene, 25.88 g (0.188 mol) of anhydrous potassium carbonate and 2.38 g (0.038 mol) of a copper powder were mixed, and while introducing a nitrogen gas, the resulting mixture was heated to 200° C. and stirred for 6 hours. After completion of the reaction, 22.3 g of potassium hydroxide dissolved in 20 ml of water and 50 ml of Isoamyl alcohol were added to conduct hydrolysis at 130° C. for 2 hours. After completion of the hydrolysis 250 ml of water was added, and isoamyl alcohol was removed by azeotropic distillation. 200 ml of toluene was added to dissolve the reaction product. After filtration, the reaction product was dehydrated with magnesium sulfate. After filtering out the magnesium sulfate, the filtrate was concentrated, and purified with column chromatography (carrier:silica gel, elute:toluene:hexane=1:4) to obtain 32.3 of indan-5-yl-p-tolylamine.

18.1 g (0.081 mol) of Indan-5-yl-p-tolylamine, 18.9 g (0.039 mol) of 4,4"-diiodo-p-terphenyl, 7.2 g (0.052 mol) of anhydrous potassium carbonate, 0.76 g (0.012 mol) of a copper powder and 30 ml of n-dodecane were mixed, and while introducing a nitrogen gas, the resulting mixture was heated to 200 to 210° C. and stirred for 30 hours. After completion of the reaction, the reaction product was extracted with 400 ml of toluene, insoluble contents were removed by filtration and the filtrate was concentrated to dryness. The solid obtained was purified with column chromatography (carrier:silica gel, elute:toluene:hexane=1:4) to obtain 19.9 g of N—N'-bisinndan-5-yl-N,N-di-p-tolyl-4,4"-diamino-p-terphenyl (compound (3)) (yield: 75.7%, melting point: 207.4 to 208.1° C.)

It was identified as compound (3) by elementary analysis and IR measurement. Elementary analysis values are as follows. Carbon: 89.13% (89.25%, hydrogen: 6.63% (6.59%), and nitrogen: 4.24% (4.16%) (calculated values are shown in the parenthesis)

EXAMPLE 4

Photosensitive Body Example 1

1 part of alcohol-soluble polyamide (AMILAN CM-400, a product of Toray Industries, Inc.) was dissolved in 13 parts of methanol. 5 parts of titanium oxide (TIPAQUE CR-EL, a product of Ishihara Sangyo Kaisha, Ltd.) was added to the solution. The titanium oxide was dispersed with a paint shaker for 8 hours to prepare a coating liquid for an undercoat layer. The coating liquid was applied to an aluminum surface of an aluminum-deposited PET film using a wire bar to form an undercoat layer having a thickness of 1 μm.

1.5 parts of the following titanyl phthalocyanine (charge generating agent No. 1) having strong peaks of a diffraction angle 2θ±0.2° in X-ray diffraction spectrum of Cu—Kα at 9.6, 24.1 and 27.2

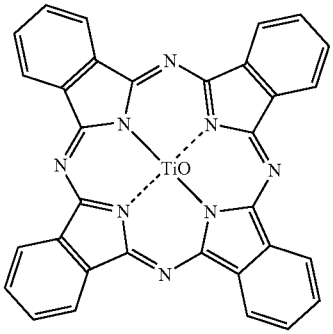

was added to 50 parts of a 3% cyclohexanone solution of a polyvinyl butyral resin (S-LEC BT-S, a product of Sekisui Chemical Co., Ltd.), and dispersed with an ultrasonic dispersing machine for 1 hour. The dispersion obtained was applied to the undercoat layer using a wire bar, and dried at 110° C. under atmospheric pressure for 1 hour to form a charge generating layer having a thickness of 0.6 μm.

On the other hand, 5.3 parts of the exemplified compound 1-(6) as an additive and 100 parts of the p-terphenyl compound of compound (1) as a charge transport agent (charge transport agent No. 1) were added to 962 parts of a 13.0% tetrahydrofuran solution of a polycarbonate resin (IUPILON, a product of Mitsubishi Engineering-Plastics Corporation), and the additive and the p-terphenyl compound were completely dissolved by applying ultrasonic wave. This solution was applied to the charge generating layer obtained above with a wire bar, and dried at 110° C. under atmospheric pressure for 30 minutes to form a charge transport layer having a thickness of 20 μm. Thus, a photosensitive body was prepared.

EXAMPLE 5

Photosensitive Body Example 2

A photosensitive body was prepared in the same manner as in Example 4, except for using the exemplified compound 3-(6) in place of the exemplified compound 1(-6).

EXAMPLE 6

Photosensitive Body Example 3

A photosensitive body was prepared in the same manner as in Example 4, except for using the exemplified compound 4-(8) in place of the exemplified compound 1-(6).

EXAMPLE 7

Photosensitive Body Example 4

A photosensitive body was prepared in the same manner as in Example 4, except for using the exemplified compound 6-(5) in place of the exemplified compound 1-(6).

EXAMPLE 8

Photosensitive Body Example 5

A photosensitive body was prepared in the same manner as in Example 4, except for using the exemplified compound 10-(6) in place of the exemplified compound 1-(6).

EXAMPLE 9

Photosensitive Body Example 6

A photosensitive body was prepared in the same manner as in Example 5, except for using titanyl phthalocyanine having strong peaks of a diffraction angle 2θ±0.2° in X-ray diffraction spectrum of Cu—Kα at 7.5 10.3, 12.6, 22.5, 24.3 25.4 and 28.6 (charge generating agent No. 2) in place of the charge generating agent No. 1 and using the p-terphenyl compound of the compound (2) (charge transport agent No. 2) in place of the charge transport agent No. 1.

EXAMPLE 10

Photosensitive Body Example 7

A photosensitive body was prepared in the same manner as in Example 9, except for using the exemplified compound 3-(10) in place of the exemplified compound 3-(6).

EXAMPLE 11

Photosensitive Body Example 8

A photosensitive body was prepared in the same manner as in Example 5, except for using titanyl phthalocyanine having strong peaks of a diffraction angle 2θ±0.2° in X-ray diffraction spectrum of Cu—K° at 9.3, 10.6. 13.2 15.1, 20.8, 23.3 and 26.3 (charge generating agent No. 3) in place of the charge generating agent No. 1 and using the p-terphenyl compound of the compound (3) (charge transport agent No. 3) in place of the charge transport agent No. 1.

EXAMPLE 12

Photosensitive Body Example 9

A photosensitive body was prepared in the same manner as in Example 11, except for using the exemplified compound 6-(5) in place of the exemplified compound 3-(6).

EXAMPLE 13

Photosensitive Body Example 10

10 parts of alcohol-soluble polyamide (AMILAN CM-8000, a product of Toray Industries, Inc.) was dissolved in 190 parts of methanol. The resulting solution was applied to an aluminum surface of an aluminum-deposited PET film using a wire bare, and dried to form an undercoat layer having a thickness of 1 μm.

1.5 parts of the following τ-type metal-free phthalocyanine charge generating agent No. 4) as a charge generating agent

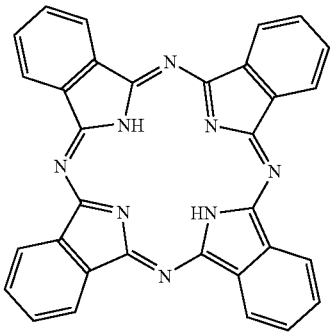

was added to 50 parts of a 3% cyclohexanone solution of a polyvinyl butyral resin (S-LEC BL-S, a product of Sekisui Chemical Co., Ltd.), and dispersed with an ultrasonic dispersing machine for 1 hour. The dispersion obtained was applied to the undercoat layer obtained above using a wire bar, and dried at 110° C. under atmospheric pressure for 1 hour to form a charge generating layer having a thickness of 0.6 μm.

On the other hand, 5.3 parts of the exemplified compound 6-(5) as an additive and 100 parts of the charge transport agent No. 3 as a charge transport agent were added to 962 parts of a 13.0% tetrahydrofuran solution of a polycarbonate resin (IUPILON Z, a product of Mitsubishi Engineering-Plastics Corporation), and the additive and the p-terphenyl compound were completely dissolved by applying ultrasonic wave. This solution was applied to the charge generating layer obtained above with a wire bar, and dried at 110° C. under atmospheric pressure for 30 minutes to form a charge transport layer having a thickness of 20 μm. Thus, a photosensitive body was prepared.

EXAMPLE 14

Photosensitive Body Example 11

A photosensitive body was prepared in the same manner as in Example 9 except for using a mixture of the charge transport agent No. 3 and the p-terphenyl compound of the compound (4) (charge transport agent No. 4) in a mass ratio of 8:2 in place of the charge transport No. 2.

EXAMPLE 15

Photosensitive Body Example 12

A photosensitive body was prepared in the same manner as in Example 14, except for using the exemplified compound 6-(5) in place of the exemplified compound 3-(6).

EXAMPLE 16

Photosensitive Body Example 13

1.0 part of the following bisazo pigment (charge generating agent No. 5) as a charge generating agent

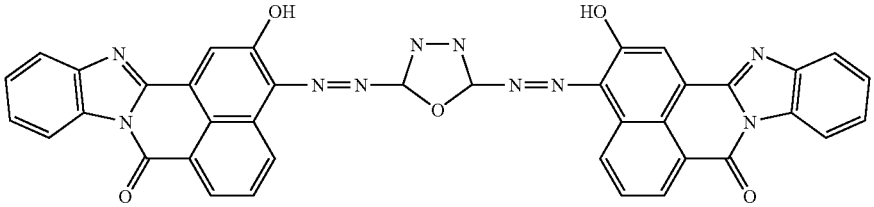

and 8.6 parts of a 5% cyclohexanone solution of a polyvinyl butyral resin (S-LEC BL-S, a product of Sekisui Chemical Co., Ltd.) were added to 83 parts of cyclohexanone, and grinding and dispersing treatment was conducted with ball mill for 48 hours. The dispersion obtained was applied to an aluminum surface of an aluminum-deposited PET film as a conductive support using a wire bar, and dried to form a charge generating layer having a thickness of 0.8 μm.

On the other hand, 5.3 parts of the exemplified compound 3-(6) as an additive and 100 parts of the charge transport agent No. 1 as a charge generating agent were added to 962 parts of a 13.0% tetrahydrofuran solution of a polycarbonate resin (IUPILON Z, a product of Mitsubishi Engineering-Plastics Corporation), and the additive and the p-terphenyl compound were completely dissolved by applying ultrasonic wave. This solution was applied to the charge generating layer obtained above with a wire bar, and dried at 110° C. under atmospheric pressure for 30 minutes to form a charge transport layer having a thickness of 20 μm. Thus, a photosensitive body was prepared.

EXAMPLE 17

Photosensitive Body Example 14

A photosensitive body was prepared in the same manner as in Example 17, except for using the following bisazo pigment (charge generating agent No. 6) in place of the charge generating No. 5.

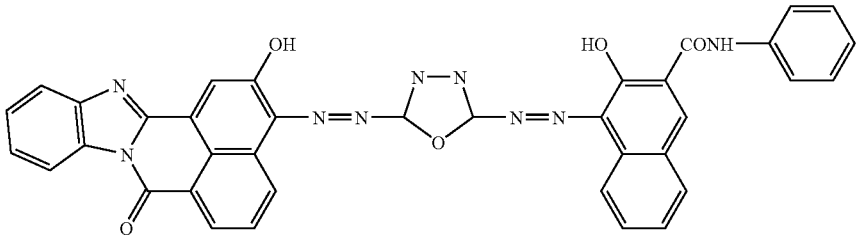

EXAMPLE 18

Photosensitive Body Example 15

1.0 part of the following bisazo pigment as a charge generating agent (charge generating agent No. 7)

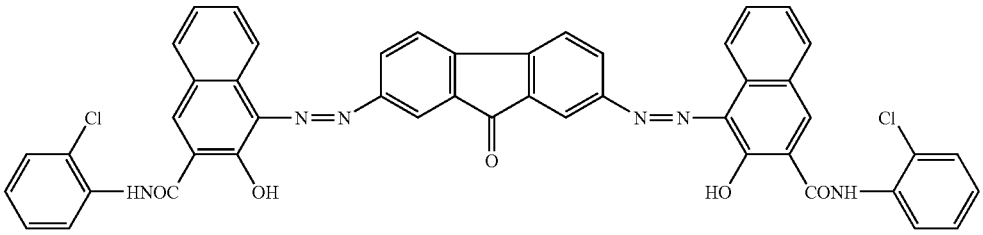

and 8.6 parts of a 5% tetrahydrofuran solution of a polyester resin (VYLON, a product of Toyobo Co., Ltd.) were added to 83 parts of tetrahydrofuran, and grinding and dispersing treatment was conducted with ball mill for 48 hours. The dispersion obtained was applied to an aluminum surface of an aluminum-deposited PET film as a conductive support using a wire bar, and dried to form a charge generating layer having a thickness of 0.8 μm.

On the other hand, 5.3 parts of the exemplified compound 3-(6) as an additive and 100 parts of the charge transport agent No. 1 as a charge generating agent were added to 962 parts of a 13.0% tetrahydrofuran solution of a polycarbonate resin (IUPILON Z, a product of Mitsubishi Engineering-Plastics Corporation) and the additive and the p-terphenyl compound were completely dissolved by applying ultrasonic wave. This solution was applied to the charge generating layer obtained above with a wire bar, and dried at 110° C. under atmospheric pressure for 30 minutes to form a charge transport layer having a thickness of 20 μm. Thus, a photosensitive body was prepared

COMPARATIVE EXAMPLE 1

A photosensitive body for comparison was prepared in the same manner as in Example 4, except for excluding the exemplified compound 1-(6).

COMPARATIVE EXAMPLE 2

A photosensitive body for comparison was prepared in the same manner as in Example 9, except for excluding the exemplified compound 3-(6).

COMPARATIVE EXAMPLE 3

A photosensitive body for comparison was prepared in the same manner as in Example 14, except for excluding the exemplified compound 3-16).

COMPARATIVE EXAMPLE 4

A photosensitive body for comparison was prepared in the same manner as in Example 17, except for excluding the exemplified compound (6).

EXAMPLE 19

Electrophotographic characteristics of the photosensitive bodies prepared in Examples 4 to 15 and Comparative Examples 1 to 3 were evaluated using a photosensitive drum characteristic-measuring apparatus (trade name: ELYSIA-II, a product of TREK JAPAN). First, the photosensitive body was subjected to corona discharge of −5.5 kV in a dark place, and an erase lamp of 70 lux was lighted. Charged potential $V_0$ at this time was measured. Next, the photosensitive body was exposed with monochromatic light of image exposure 780 nm-30 μW to obtain residual potential $V_r$. This photosensitive body was exposed to an ozone gas of 20 ppm in a room under illumination of fluorescent lamps for 5 days, and then charged potential $V_0$ and residual potential $V_r$ were measured in the same manner as in before exposure. The results are shown in Table 11.

TABLE 11

| Example and Comparative Example | Charge generating agent No. | Charge transport agent No. | Additive No. | Charged potential $V_0$ (−V) | | Residual potential $V_r$ (−V) | |
|---|---|---|---|---|---|---|---|
| | | | | Before ozone gas exposure | After ozone gas exposure | Before ozone gas exposure | After ozone gas exposure |
| Example 4 | 1 | 1 | 1-(6) | 654 | 631 | 9 | 13 |
| Example 5 | 1 | 1 | 3-(6) | 678 | 646 | 12 | 18 |
| Example 6 | 1 | 1 | 4-(8) | 642 | 623 | 5 | 13 |
| Example 7 | 1 | 1 | 6-(5) | 651 | 644 | 19 | 24 |
| Example 8 | 1 | 1 | 10-(6) | 692 | 643 | 15 | 20 |
| Example 9 | 2 | 2 | 3-(6) | 589 | 563 | 29 | 31 |
| Example 10 | 2 | 2 | 3-(10) | 576 | 559 | 22 | 27 |
| Example 11 | 3 | 3 | 3-(6) | 684 | 654 | 21 | 25 |
| Example 12 | 3 | 3 | 6-(5) | 669 | 643 | 24 | 28 |
| Example 13 | 4 | 3 | 6-(5) | 711 | 687 | 43 | 48 |
| Example 14 | 2 | 3, 4 | 3-(6) | 588 | 559 | 28 | 33 |
| Example 15 | 2 | 3, 4 | 6-(5) | 567 | 545 | 24 | 29 |
| Comparative Example 1 | 1 | 1 | — | 628 | 469 | 7 | 69 |
| Comparative Example 2 | 2 | 2 | — | 595 | 436 | 26 | 69 |
| Comparative Example 3 | 2 | 3, 4 | — | 592 | 440 | 22 | 65 |

EXAMPLE 20

Electrophotographic characteristics of the photosensitive bodies prepared in Examples 16 to 18 and Comparative Example 4 were evaluated using a photosensitive drum characteristic-measuring apparatus (trade name: ELYSIA-II, a product of TREK JAPAN). First, the photosensitive body was subjected to corona discharge of −4.8 kV in a dark place, and an erase lamp of 70 lux was lighted. Charged potential $V_0$ at this time was measured Next, the photosensitive body was exposed with monochromatic light of image exposure 40 lux to obtain residual potential $V_r$. This photosensitive body was exposed to an ozone gas of 20 ppm in a room under illumination of fluorescent lamps for 5 days, and charged potential $V_0$ and residual potential $V_r$ were measured in the same manner as in before exposure. The results are shown in Table 12.

TABLE 12

| Example and Comparative Example | Charge generating agent No. | Charge transport agent No. | Additive No. | Charged potential $V_0$ (−V) Before ozone gas exposure | Charged potential $V_0$ (−V) After ozone gas exposure | Residual potential $V_r$ (−V) Before ozone gas exposure | Residual potential $V_r$ (−V) After ozone gas exposure |
|---|---|---|---|---|---|---|---|
| Example 16 | 5 | 1 | 3-(6) | 720 | 700 | 25 | 31 |
| Example 17 | 6 | 1 | 3-(6) | 711 | 691 | 22 | 29 |
| Example 18 | 7 | 1 | 3-(6) | 725 | 689 | 11 | 20 |
| Comparative Example 4 | 5 | 1 | — | 725 | 513 | 20 | 64 |

As described above, the present invention can provide an electrophotographic photosensitive body which shows less change in charged potential and residual potential and which is excellent in durability, by using in combination a p-terphenyl compound having a specific structure as a charge transport agent and a compound having a specific structure as an additive.

While the present invention has been described in detail and with reference to specific embodiments thereof, it will be apparent to one skilled in the art that various modifications and changes can be made therein without departing from the spirit and scope thereof.

This application is based on Japanese Patent Application No. 2004-338784 filed Nov. 24, 2004, the disclosure of which is incorporated herein by reference in its entity.

INDUSTRIAL APPLICABILITY

The present invention is useful as an electrophotographic photosensitive body which shows less change in electrophotographic characteristics and which is capable of realizing high durability.

The invention claimed is:

1. An electrophotographic photosensitive body comprising a conductive support having thereon a layer comprising at least one p-terphenyl compound selected from the following compounds (1) to (5)

(1)

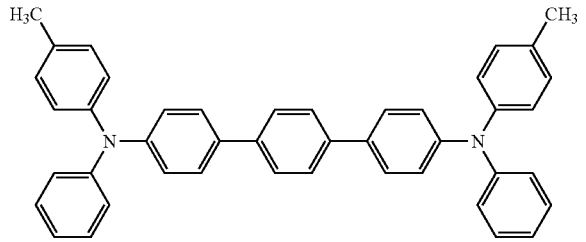

-continued (2)

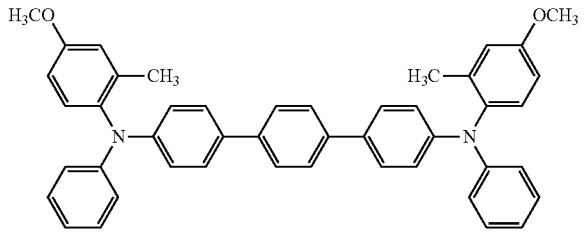

(3)

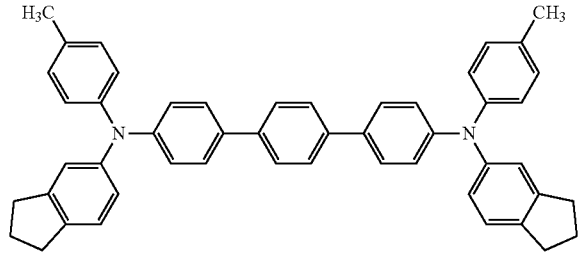

(4)

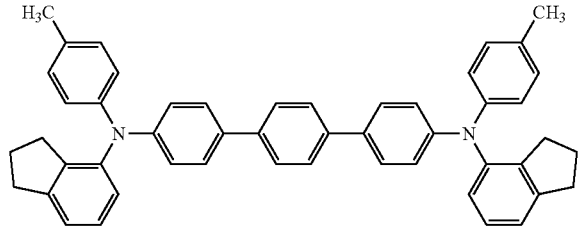

-continued (5)

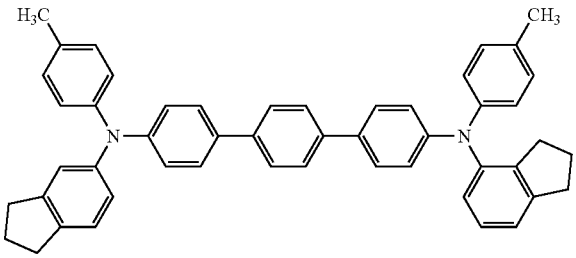

and an additive, wherein the additive comprises at least one selected from the group consisting of:

an organic phosphite compound represented by general formula (A1)

(A1)

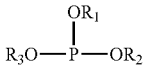

wherein $R_1$, $R_2$ and $R_3$ which may be the same or different represent a hydrogen atom, a substituted or unsubstituted alkyl group, a substituted or unsubstituted alkenyl group or a substituted or unsubstituted aryl group, with the proviso that the case where $R_1$, $R_2$ and $R_3$ are all hydrogen atoms simultaneously is excluded;

a triphenylated phosphorus compound represented by general formula (A2)

(A2)

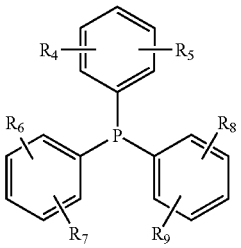

wherein $R_4$, $R_5$, $R_6$, $R_7$, $R_8$ and $R_9$ which may be the same or different represent a hydrogen atom, a halogen atom, a hydroxyl group, a substituted or unsubstituted alkoxy group, a substituted or unsubstituted amino group or a substituted or unsubstituted alkyl group;

a thioether compound represented by general formula (A3)

$$R_{10}—S—R_{11} \quad (A3)$$

wherein $R_{10}$ and $R_{11}$ which may be the same or different represent a substituted or unsubstituted alkyl group, a substituted or unsubstituted alkenyl group or a substituted or unsubstituted aryl group;

a hydroquinone compound represented by general formula (A4)

(A4)

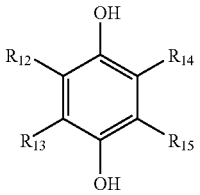

wherein $R_{12}$, $R_{13}$, $R_{14}$ and $R_{15}$ which may be the same or different represent a hydrogen atom, a substituted or unsubstituted alkyl group, a substituted or unsubstituted alkenyl group, a substituted or unsubstituted aryl group, a substituted or unsubstituted amino group, a substituted or unsubstituted arylthio group, a substituted or unsubstituted acyl group, a substituted or unsubstituted silyl group, a substituted or unsubstituted aryloxy group or a substituted or unsubstituted phosphino group;

a benzotriazole compound represented by general formula (A5)

(A5)

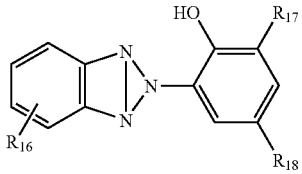

wherein $R_{16}$, $R_{17}$ and $R_{18}$ which may be the same or different represent a hydrogen atom, a halogen atom, a substituted or unsubstituted alkyl group, a substituted or unsubstituted alkenyl group or a substituted or unsubstituted aryl group;

a benzotriazole-alkylene bisphenol compound represented by general formula (A6)

(A6)

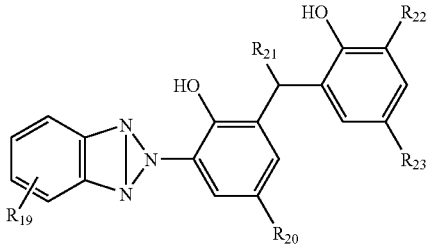

wherein $R_{19}$ represents a hydrogen atom, a halogen atom, a substituted or unsubstituted alkyl group, a substituted or unsubstituted cycloalkyl group, a substituted or unsubstituted alkoxy group or a substituted or unsubstituted aryl group, $R_{20}$ represents a substituted or unsubstituted alkyl group, a substituted or unsubstituted cycloalkyl group, a substituted or unsubstituted aryl group, a substituted or unsubstituted alkoxy group or a substituted or unsubstituted aralkyl group, $R_{21}$ represents a hydrogen atom, a substituted or unsubstituted alkyl group or a substituted or unsubstituted aryl group, and $R_{22}$ and $R_{23}$ which may be the same or different represent a substituted or unsubstituted alkyl group, a substituted or unsubstituted cycloalkyl group, a substituted or unsubstituted aryl group or a substituted or unsubstituted alkyl aryl group;

a hydroxybenzophenone compound represented by general formula (A7)

(A7)

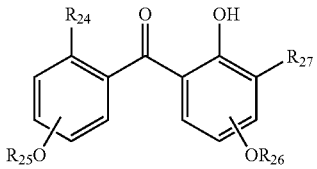

wherein $R_{24}$ represents a hydrogen atom or a hydroxyl group, $R_{25}$ and $R_{26}$ which may be the same or different represent a hydrogen atom, a substituted or unsubstituted alkyl group, a substituted or unsubstituted alkenyl group or a substituted or unsubstituted aryl group, and $R_{27}$ represents a hydrogen atom, a substituted or unsubstituted alkyl group or a substituted or unsubstituted aralkyl group;

a hindered phenol compound represented by general formula (A8)

(A8)

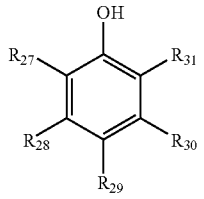

wherein $R_{27}$ represents a substituted or unsubstituted alkyl group, and $R_{28}$, $R_{29}$, $R_{30}$ and $R_{31}$ which may be the same or different represent a hydrogen atom, a substituted or unsubstituted alkyl group, a substituted or unsubstituted aryl group or a substituted or unsubstituted alkoxy group, or general formula (A9)

(A9)

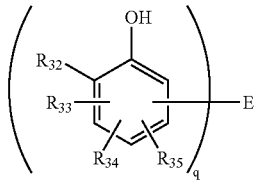

wherein $R_{32}$ represents a substituted or unsubstituted alkyl group, $R_{33}$, $R_{34}$ and $R_{35}$ which may be the same or different represent a hydrogen atom, a substituted or unsubstituted alkyl group or a substituted or unsubstituted alkoxy group, q is an integer of 2, 3 or 4, and E represents an oxygen atom, a sulfur atom or an aliphatic divalent group when q is 2, represents an aliphatic trivalent group or an aromatic trivalent group when q is 3, and represents an aliphatic tetravalent group when q is 4;

a hindered amine compound represented by general formula (A10)

(A10)

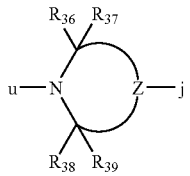

wherein $R_{36}$, $R_{37}$, $R_{38}$ and $R_{39}$ which may be the same or different represent a hydrogen atom, a substituted or unsubstituted alkyl group or a substituted or unsubstituted aryl group, Z represents an atomic group necessary to form a nitrogen-containing heterocycle, wherein in the pair of $R_{36}$ and $R_{37}$ and the pair of $R_{38}$ and $R_{39}$, one of them may be incorporated into Z to form a double bond, u represents a hydrogen atom, an oxygen atom, a substituted or unsubstituted alkyl group or a substituted or unsubstituted acyl group, and j represents a hydroxyl group, a substituted or unsubstituted acyloxy group, a substituted or unsubstituted benzoyl group or other organic residues; and a salicylate compound represented by general formula (A11)

(A11)

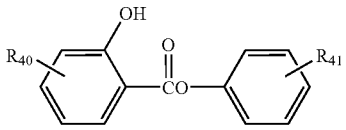

wherein $R_{40}$ and $R_{41}$ which may be the same or different represent a hydrogen atom, a substituted or unsubstituted alkyl group, a substituted or unsubstituted alkenyl group or a substituted or unsubstituted aryl group; and wherein the layer contains the additive in an amount of from 0.05 to 30 mass % based on the p-terphenyl compound.

2. The electrophotographic photosensitive body as claimed in claim 1, wherein the additive is contained in an amount of from 0.1 to 20mass % based on the p-terphenyl compound.

3. The electrophotographic photosensitive body according to claim 1, comprising the p-terphenyl compound of formula (1).

4. An electrophotographic photosensitive body, comprising:

a conductive support and a layer comprising at least one p-terphenyl compound selected from the group consisting of:

(2)

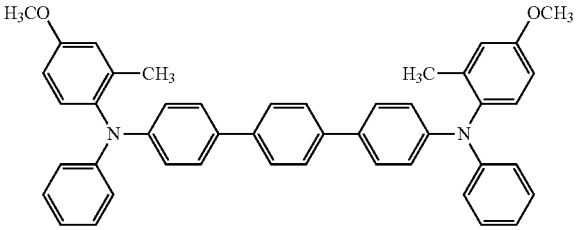

(3)

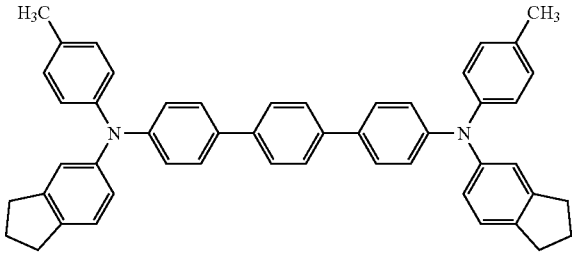

(4)

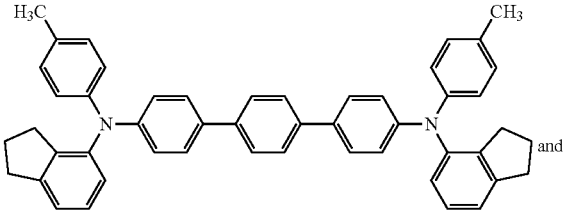

and

-continued (5)

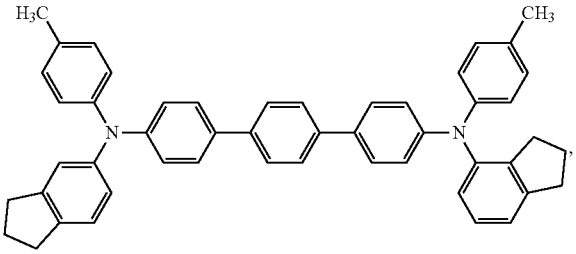

wherein the layer is present on the conductive support;

and at least one additive selected from the group consisting of:

an organic phosphite compound represented by general formula (A1)

(A1)

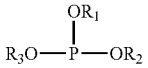

wherein $R_1$, $R_2$ and $R_3$ which may be the same or different represent a hydrogen atom, a substituted or unsubstituted alkyl group, a substituted or unsubstituted alkenyl group or a substituted or unsubstituted aryl group, with the proviso that the case where $R_1$, $R_2$ and $R_3$ are all hydrogen atoms simultaneously is excluded;

a triphenylated phosphorus compound represented by general formula (A2)

(A2)

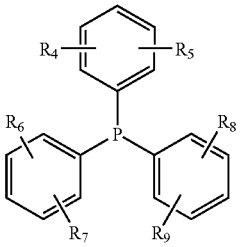

wherein $R_4$, $R_5$, $R_6$, $R_7$, $R_8$ and $R_9$ which may be the same or different represent a hydrogen atom, a halogen atom, a hydroxyl group, a substituted or unsubstituted alkoxy group, a substituted or unsubstituted amino group or a substituted or unsubstituted alkyl group;

a thioether compound represented by general formula (A3)

$$R_{10}—S—R_{11} \quad (A3)$$

wherein $R_{10}$ and $R_{11}$ which may be the same or different represent a substituted or unsubstituted alkyl group, a substituted or unsubstituted alkenyl group or a substituted or unsubstituted aryl group;

a hydroquinone compound represented by general formula (A4)

(A4)

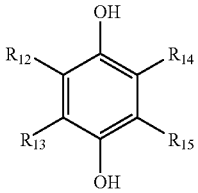

wherein $R_{12}$, $R_{13}$, $R_{14}$ and $R_{15}$ which may be the same or different represent a hydrogen atom, a substituted or unsubstituted alkyl group, a substituted or unsubstituted alkenyl group, a substituted or unsubstituted aryl group, a substituted or unsubstituted amino group, a substituted or unsubstituted arylthio group, a substituted or unsubstituted acyl group, a substituted or unsubstituted silyl group, a substituted or unsubstituted aryloxy group or a substituted or unsubstituted phosphino group;

a benzotriazole compound represented by general formula (A5)

(A5)

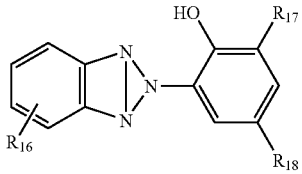

wherein $R_{16}$, $R_{17}$ and $R_{18}$ which may be the same or different represent a hydrogen atom, a halogen atom, a substituted or unsubstituted alkyl group, a substituted or unsubstituted alkenyl group or a substituted or unsubstituted aryl group;

a benzotriazole-alkylene bisphenol compound represented by general formula (A6)

(A6)

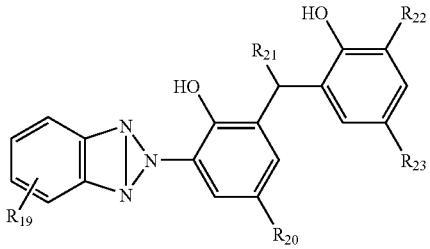

wherein $R_{19}$ represents a hydrogen atom, a halogen atom, a substituted or unsubstituted alkyl group, a substituted or unsubstituted cycloalkyl group, a substituted or unsubstituted alkoxy group or a substituted or unsubstituted aryl group, $R_{20}$ represents a substituted or unsubstituted alkyl group, a substituted or unsubstituted cycloalkyl group, a substituted or unsubstituted aryl group, a substituted or unsubstituted alkoxy group or a substituted or unsubstituted aralkyl group, $R_{21}$ represents a hydrogen atom, a substituted or unsubstituted alkyl group or a substituted or unsubstituted aryl group, and $R_{22}$ and $R_{23}$ which may be the same or different represent a substituted or unsubstituted alkyl group, a substituted or unsubstituted cycloalkyl group, a substituted or unsubstituted aryl group or a substituted or unsubstituted alkyl aryl group;

a hydroxybenzophenone compound represented by general formula (A7)

(A7)

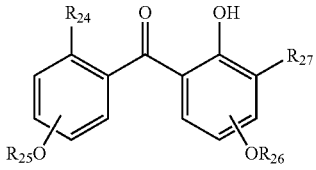

wherein $R_{24}$ represents a hydrogen atom or a hydroxyl group, $R_{25}$ and $R_{26}$ which may be the same or different represent a hydrogen atom, a substituted or unsubstituted alkyl group, a substituted or unsubstituted alkenyl group or a substituted or unsubstituted aryl group, and $R_{27}$ represents a hydrogen atom, a substituted or unsubstituted alkyl group or a substituted or unsubstituted aralkyl group;

a hindered phenol compound represented by general formula (A8)

(A8)

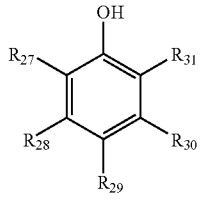

wherein $R_{27}$ represents a substituted or unsubstituted alkyl group, and $R_{28}$, $R_{29}$, $R_{30}$ and $R_{31}$ which may be the same or different represent a hydrogen atom, a substituted or unsubstituted alkyl group, a substituted or unsubstituted aryl group or a substituted or unsubstituted alkoxy group, or general formula (A9)

(A9)

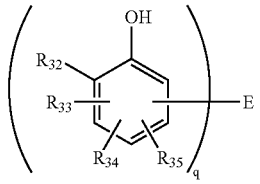

wherein $R_{32}$ represents a substituted or unsubstituted alkyl group, $R_{33}$, $R_{34}$ and $R_{35}$ which may be the same or different represent a hydrogen atom, a substituted or unsubstituted alkyl group or a substituted or unsubstituted alkoxy group, q is an integer of 2, 3 or 4, and E represents an oxygen atom, a sulfur atom or an aliphatic divalent group when q is 2, represents an aliphatic trivalent group or an aromatic trivalent group when q is 3, and represents an aliphatic tetravalent group when q is 4;

a hindered amine compound represented by general formula (A10)

(A10)

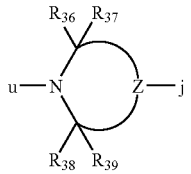

wherein $R_{36}$, $R_{37}$, $R_{38}$ and $R_{39}$ which may be the same or different represent a hydrogen atom, a substituted or unsubstituted alkyl group or a substituted or unsubstituted aryl group, Z represents an atomic group necessary to form a nitrogen-containing heterocycle, wherein in the pair of $R_{36}$ and $R_{37}$ and the pair of $R_{38}$ and $R_{39}$, one of them may be incorporated into Z to form a double bond, u represents a hydrogen atom, an oxygen atom, a substituted or unsubstituted alkyl group or a substituted or unsubstituted acyl group, and j represents a hydroxyl group, a substituted or unsubstituted acyloxy group, a substituted or unsubstituted benzoyl group or other organic residues; and a salicylate compound represented by general formula (A11)

(A11)

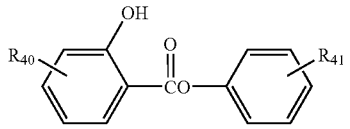

wherein $R_{40}$ and $R_{41}$ which may be the same or different represent a hydrogen atom, a substituted or unsubstituted alkyl group, a substituted or unsubstituted alkenyl group or a substituted or unsubstituted aryl group; and wherein the layer contains the additive in an amount of from 0.05 to 30 mass % based on the p-terphenyl compound.

5. The electrophotographic photosensitive body according to claim 4, comprising a p-terphenyl compound of formula (2).

6. The electrophotographic photosensitive body according to claim 4, comprising a p-terphenyl compound of formula (3).

7. The electrophotographic photosensitive body according to claim 4, comprising a p-terphenyl compound of formula (4).

8. The electrophotographic photosensitive body according to claim 4, comprising a p-terphenyl compound of formula (5).

9. The electrophotographic photosensitive body as claimed in claim 4, wherein the additive is contained in an amount of from 0.1 to 20 mass % based on the p-terphenyl compound.

10. The electrophotographic photosensitive body according to claim 9, wherein the additive is the organic phosphite compound (A1).

11. The electrophotographic photosensitive body according to claim 9, wherein the additive is the triphenylated phosphorus compound of formula (A2).

12. The electrophotographic photosensitive body according to claim 9, wherein the additive is the thioether compound of formula (A3).

13. The electrophotographic photosensitive body according to claim 9, wherein the additive is the hydroquinone compound of formula (A4).

14. The electrophotographic photosensitive body according to claim 9, wherein the additive is the benzotriazole compound of formula (A5).

15. The electrophotographic photosensitive body according to claim 9, wherein the additive is the benzotriazole-alkylenebisphenol of formula (A6).

16. The electrophotographic photosensitive body according to claim 9, wherein the additive is the hydroxybenzophenone compound of formula (A7).

17. The electrophotographic photosensitive body according to claim 9, wherein the additive is the hindered phenol compound of formula (A8).

18. The electrophotographic photosensitive body according to claim 9, wherein the additive is the hindered amine compound of formula (A10).

19. The electrophotographic photosensitive body according to claim 9, wherein the additive is the salicylic compound of formula (A11).

* * * * *